US011840925B2

(12) United States Patent
Pogrebinsky

(10) Patent No.: US 11,840,925 B2
(45) Date of Patent: Dec. 12, 2023

(54) SYSTEM AND METHOD FOR DOWNLINKING CONTINUOUS COMBINATORIAL FREQUENCIES ALPHABET

(71) Applicant: Michael Simon Pogrebinsky, Houston, TX (US)

(72) Inventor: Michael Simon Pogrebinsky, Houston, TX (US)

( * ) Notice: Subject to any disclaimer, the term of this patent is extended or adjusted under 35 U.S.C. 154(b) by 115 days.

(21) Appl. No.: 17/556,502

(22) Filed: Dec. 20, 2021

(65) Prior Publication Data

US 2023/0193750 A1 Jun. 22, 2023

(51) Int. Cl.

| | |
|---|---|
| ***E21B 47/16*** | (2006.01) |
| ***E21B 47/12*** | (2012.01) |
| ***E21B 47/18*** | (2012.01) |
| ***E21B 47/08*** | (2012.01) |
| ***E21B 44/00*** | (2006.01) |

(52) U.S. Cl.

CPC ..... *E21B 47/16* (2013.01); *E21B 44/00* (2013.01); *E21B 47/08* (2013.01); *E21B 47/138* (2020.05)

(58) Field of Classification Search

None

See application file for complete search history.

(56) References Cited

U.S. PATENT DOCUMENTS

| | | | |
|---|---|---|---|
| 4,847,815 A | 7/1989 | Malone | |
| 4,908,804 A | 3/1990 | Rorden | |
| 5,102,097 A * | 4/1992 | Davis | B64D 13/02 251/283 |
| 6,219,301 B1 | 4/2001 | Moriarty | |
| 6,327,524 B1 | 12/2001 | Chen | |
| 6,714,138 B1 | 3/2004 | Turner et al. | |
| 7,129,673 B2 | 10/2006 | Eisenhardt et al. | |
| 8,350,715 B2 | 1/2013 | Shearer | |

(Continued)

FOREIGN PATENT DOCUMENTS

CN 106850479 A * 6/2017 ..... H04L 27/14

OTHER PUBLICATIONS

CN-106850479-A English Language Translation (Year: 2017).*

*Primary Examiner* — Curtis A Kuntz
*Assistant Examiner* — Jerold B Murphy
(74) *Attorney, Agent, or Firm* — McCarter & English, LLP

(57) ABSTRACT

Exemplary embodiments are directed to a system and method for continuous downlinking communication from a surface location to a bottom hole assembly during drilling operations. The system transmits harmonic pressure wave fluctuations generated by a modulator, which is disposed outside of a surface-located fluid line with a flap rotatably disposed entirely inside of the fluid line encoding data by harmonics. One letter of the combinatorial frequencies signal alphabet can have more than 200 different orthogonal frequencies components; each component represents a unique combination of downlinking command purpose and value. For deepest portion of a long trajectory well, the system uses a narrow frequency range (2-3 Hz) with two letters resulting in more than 250 combinations. The system provides continuous automatic downhole control of the signal-to-noise ratio to achieve robust decoding of downlinking signals with a transmission data rate ten times faster as compared to 1-2 bits per minute in the industry.

22 Claims, 23 Drawing Sheets

(56) References Cited

U.S. PATENT DOCUMENTS

| | | | | |
|---|---|---|---|---|
| 10,113,420 | B2 | 10/2018 | Pogrebinsky et al. | |
| 2004/0012500 | A1 | 1/2004 | Hahn | |
| 2006/0114747 | A1 | 6/2006 | Hentati | |
| 2007/0189119 | A1 | 8/2007 | Klotz | |
| 2008/0007423 | A1* | 1/2008 | Krueger | E21B 47/18 340/870.18 |
| 2008/0055110 | A1 | 3/2008 | Hahn | |
| 2010/0039287 | A1 | 2/2010 | Li | |
| 2015/0345287 | A1* | 12/2015 | White | E21B 47/20 367/83 |
| 2016/0201455 | A1 | 7/2016 | Liu | |
| 2017/0284195 | A1 | 10/2017 | White | |
| 2020/0325770 | A1* | 10/2020 | Camacho Cardenas | E21B 21/08 |
| 2022/0018239 | A1* | 1/2022 | Dunbar | H04B 13/02 |

* cited by examiner 391 392

| T | Δf | NUMBER OF COMBINATIONS | |
|---|---|---|---|
| | | 1 LETTER | 2 LETTERS |
| 1 s | 1 Hz | 31 | 961 |
| 2 s | 0.5 Hz | 61 | 3721 |
| 4 s | 0.25 Hz | 121 | 14641 |
| 8 s | 0.125 Hz | 241 | 58081 |
| 16 s | 0.0625 Hz | 481 | 231361 |
| ... | | | |
| Tmax | | | |

393 394

SYSTEM AND METHOD FOR DOWNLINKING CONTINUOUS COMBINATORIAL FREQUENCIES ALPHABET

FIELD OF THE INVENTION

The present invention relates to telemetry systems for use in a wellbore during drilling and logging-while-drilling (LWD) operations. More particularly, the present invention relates to a method and system for transmitting downlinking commands from a surface-located modulator of harmonic pressure wave signals to a downhole receiver.

BACKGROUND

A well is typically drilled using a drill bit attached to the lower end of a drill string. At the bottom end of the drill string is a bottom hole assembly (BHA), which can typically include the drill bit, a downhole motor (optional), sensor(s), a source of power, a signal generator, a rotary steerable system (RSS) (optional), and circuitry. A typical BHA includes sensors that measure the BHA's orientation and position, as well as sensors that measure various properties of the formation, such as resistivity, gamma, sonic destiny, porosity, and the like. Some of the measurements can include azimuthal information. Other information and data that may be transmitted from the BHA to the surface can include, e.g., temperature, pressure, drilling parameters, and the like.

The process of drilling can be controlled by comprehensive communication using various experts and operators, and based on analysis of information obtained from the downhole and surface sensors. The drill string is rotated at a desired rate by a rotary table (or top drive) at the surface, and the operator controls the weight-on-bit and other parameters of the drilling process. Another aspect of drilling relates to the drilling fluid (mud), which is pumped from the surface to the drill string. The mud serves to cool and lubricate the drill bit, and it carries the drill cuttings back to the surface. The density of the mud is controlled to maintain hydrostatic pressure in the borehole at desired levels.

During drilling operations, various instructions are sent to the BHA from the surface in order to change adjustable drilling parameters, change logging parameters, and to change or adjust the communication parameters between the surface and downhole system to improve transfer of data. Such communications are known and referred to herein as a "downlink".

Likewise, an "uplink" (as known in the industry and referred to herein) is a communication from the BHA to the surface. An uplink is a transmission of the data collected by the sensors in the BHA. Such data can be used to confirm that the downlink command was correctly detected.

One of the most common downlinking methods in the industry includes using variation of mud flowrate, drill string rotation speed, and generations of serious of negative pressure pulses. During the downlinking process, one or more of these parameters are caused to change in magnitude or time duration and/or in numbers.

A downlink using pressure generally necessitates a bypass valve, manipulation of which causes negative pulses to be transmitted through the drilling fluid and detected by a pressure transducer. Typically, the bypass valve diverts a portion of the high-pressure fluid from the supply line back to the mud pit that is at atmospheric pressure. Such venting action can generate high fluid velocities through the valve, resulting in erosion. Valve failure due to such erosion is a safety hazarded under the high pressured environment. In addition, the data transmission speed for such downlinking process can be extremely slow.

U.S. Pat. No. 8,174,404 discusses use a pulser for downlinking which is disposed in the drilling fluid supply line without the need of a bypass valve. The disadvantage of this option is that a pulser disposed inside of the supply line significantly obscures the flow area, resulting in the need to use a higher pumping pressure level which, in turn, can cause acceleration of wear and tear of the pumping equipment.

Changing the rotational speed to send a downlink signal is not a common method due to the large rotational inertia of the entire drill string. In addition, the rotational speed changes caused by the drilling process may be improperly interpreted by the system as a downlinking command.

One method in the industry for downlinking communications is manipulation of the drilling flow rate to cause changes in the downhole turbine rotation speeds. This method necessitates that the rotary steerable system (RSS) is equipped with a turbine/turbine alternator. Further, in addition to mud pumps, such process necessitates a hydraulic bypass unit controlled by the service company. However, manipulation of the drilling flow rate for downlinking communications results in slow transmission speeds, e.g., typically about 5-10 minutes of a single downlinking command. The low transmission speed limits the amount of downlinking commands and their varieties, preventing the industry from having more control over acquisition parameters and optimal density of the observation.

SUMMARY

The present invention discloses a downlinking continuous combinatorial frequencies alphabet method and system for continuous downlinking communication during logging-while-drilling (LWD) and measurement-while-drilling (MWD) operations from a surface location to a downhole location by using a pressure wave modulator disposed entirely outside of a surface fluid supply line, with only the rotational flap of the modulator being disposed inside of the fluid supply line pipe. The pulser therefore does not obscure or block the flow area of the fluid supply line pipe, ensuring the desired pumping pressures are maintained. The exemplary mud pulse telemetry system provides a fast and robust, continuous downlinking operation capable of providing optimization of data acquisition and improves management for the rotary steerable system (RSS).

In some embodiments, the periodical signals used by the system are frequencies or orthogonal frequencies. In some embodiments, the combinatorial alphabet frequencies method used by the system can include selection and evaluation of the existing modulator or a selection of a modulator based on the required value of maximum frequency (Fmax) which a modulator is configured to generate.

In some embodiments of present disclosure, an evaluation of a modulator includes establishing a function of frequencies amplitude from an angle of the flap by using flow loop measuring or numerical simulation methods. In some embodiments, the method can include selecting for a flap an oscillating range or a few ranges between minimum angular rotation position ($\varphi min_i$) and a maximum angular rotation position ($\varphi max_i$) based on the function of pressure wave amplitude from a rotational angle $\varphi$. A horizontal position of the flap can be designated as angular rotation position $\varphi=0°$. An open area for mud flow can have a maximum value at a maximum angular rotation position ($\varphi min_i$) and a corresponding pressure wave amplitude has a minimum value.

In accordance with embodiments of the present disclosure, an exemplary method for continuous downlinking communication from a surface location to a bottom hole assembly during drilling operation. The method includes pumping drilling fluid through a surface-located fluid line and through a drill string to the bottom hole assembly. The method includes generating continuous pressure wave signals with a modulator associated with the surface-located fluid line, each signal of the pressure wave signals including at least one letter of a downlinking combinatorial frequencies alphabet. The method includes detecting and receiving at the bottom hole assembly the continuous pressure wave signals generated by the modulator. The method includes processing and decoding the continuous pressure wave signals with a decoder associated with the bottom hole assembly to identify digital signal periodical components, and determine a command type and value, for controlling drilling operations.

The at least one letter of the downlinking combinatorial frequencies alphabet includes one or more orthogonal frequencies. The alphabetic component with a highest frequency $F_{max}$ is determined based on evaluation of the modulator. A selection of the modulator is based on a required value of the highest frequency $F_{max}$. The modulator is coupled to the surface-located fluid line. The modulator includes a flap rotatably disposed within the modulator such that the flap is entirely disposed within the surface-located fluid line.

The method includes selectively rotating the flap within the surface-located fluid line to vary an amplitude of the continuous pressure wave signals generated by the modulator. The amplitude of the continuous pressure wave signals generated by the modulator is a function of and correlates to an angular position of the flap relative to a direction of fluid flow within the surface-located fluid line. The method includes selecting three or more oscillating ranges for the flap. A first oscillating range can generate a pressure wave amplitude of 15-25 psi inclusive. A second oscillating range can generate a pressure wave amplitude of 40-50 psi inclusive. A third oscillating range can generate a pressure wave amplitude of 80-90 psi inclusive.

An amount of orthogonal frequencies K in the downlinking combinatorial frequencies alphabet can be determined based on a range of frequencies from a minimum frequency $F_{min}$, to a maximum frequency $F_{max}$, and on a selected equivalent duration T of output of a single alphabet member of the downlinking combinatorial frequencies alphabet by: $K=((F_{max}-F_{min})/\Delta f)+1$, where $\Delta f=1/T$ represents a difference in Hz of adjacent orthogonal frequencies, and $T=1,024*2^n$ ms, where n=0, 1, 2 . . . .

The maximum frequency $F_{max}$ is assigned as an assertion frequency $F_a$, and an amount of orthogonal frequencies in the combinatorial frequencies alphabet K* is calculated by $K^*=K-1$. An output signal is a combination of one or two alphabet letters, where a second letter of the two alphabet letters is adjacent to a first letter. If an amount of frequencies components for one letter is greater than an amount of all predefined downlinking commands including general purpose and communication group instructions for managing RSS and optimization prescription, then a downlinking command includes from one letter with a structure as $\{F_a, F_{si}, F_a\}$, where $F_{si}$ is one of the frequencies components form the range from $F_{min}$ to $F_{max}-\Delta f$, each signal frequency component represents a unique combination of one downlinking command purpose and its value. If the amount of predefined downlinking commands is greater than an amount of the frequencies components of one letter of the combinatorial alphabet, a downlinking signal includes from two letters with a structure as $\{F_a, F_{si}, F_{si}, F_a\}$, where $F_{si}$, $F_{si}$ are frequencies components, the combination of downlinking command purpose and its value, and the combination $F_{si}$, $F_{si}$, represents one of the downlinking commands.

The method includes adjusting the range of frequencies for attenuation during propagation of the continuous pressure wave signals from the modulator to the bottom hole assembly. An effect of the attenuation is represented by:

$$P = P_0 \exp\left[-4\pi f\left(\frac{D}{d}\right)^2\left(\frac{\mu}{K}\right)\right]$$

where P is a signal strength at a surface transducer, $P_0$ is a signal strength at the modulator, f is a carrier frequency of a measurement-while-logging signal, D is a measured depth between a downhole transducer and the modulator, d is an inside diameter of a drill pipe, μ is a plastic viscosity of the drilling fluid, an K is a bulk modulus of a volume of drilling fluid above the downhole transducer.

Based on an effect of the attenuation on higher frequencies alphabet members, a length of a drilling well is divided by two of more intervals and each interval has a different value of maximum frequency $Fmax_i$, where i is a number of intervals. The modulator continually generates the maximum frequency $F_{max}$ before and after transmitting the continuous pressure wave signals to the bottom hole assembly. A division for the intervals is based on predetermined criteria for a minimum amplitude value for each frequency in order to allow robust recording of the generated continuous pressure wave signals for a pressure transducer. Robust recording necessitates that the amplitude of each frequency at the bottom hole assembly depth is 10-15 time greater than a sensitivity of the pressure transducer.

A choice of the command type and value of a downlinking command is based on a combined evaluation of real-time data from bottom hole assembly sensors, surface gages, drilling parameters, information from an onsite operator, and instruction from a remote center. The method includes encoding the downlinking command and transmitting corresponding one or more alphabet letters to a controller of the modulator to generate a harmonic pressure wave signal. The command type associated with the continuous pressure wave signals is divided into three groups: service commands, RSS commands for managing rotary steering system parameters, and optimization commands for optimization of at least one of acquisition and saving energy resources. If multiple command types are transmitted simultaneously, the method includes prioritizing the service commands as highest priority, the RSS commands as a second highest priority, and the optimization commands as lowest priority.

The method includes detecting a presence of flow of the drilling fluid by a sensor disposed in the bottom hole assembly. The sensor is a flow stat device, and the method includes initiating recording of the continuous pressure wave signals by a pressure transducer after detection of the presence of flow of the drilling fluid by the sensor. A sampling frequency of the sensor is not less than $2*F_{maxi}$, where $F_{maxi}$ is a maximum frequency for an i interval.

The method includes removing a constant zero frequency component, applying band-pass filtering and preforming band selectable Fourier analysis on a sliding base equal to a used duration of the at least one letter of the downlinking combinatorial frequencies alphabet to process the pressure wave signals recorded by the pressure transducer. A processor of the pressure transducer recognizes harmonics, which includes decoding of a downhole signal to determine a command purpose and associated command value. Decoding is based on pattern recognition of a behavior of harmonic components of the continuous pressure wave signals along a timeline after applying Fourier analysis on the sliding base.

The method includes continuously using the maximum frequency $Fmax_i$ to analyze a signal-to-white noise level ratio. A criteria for a robust detection of alphabetic harmonic components of the downlinking signals is established when an amplitude of spectrum of a signal harmonics is higher than three standard deviations of amplitude of white noise (A signal>$3*\sigma_{noise}$). An increase of the signal-to-white noise level ratio is achieved by downlinking duration of the at least one letter each time when uplink communication indicates that an amplitude of spectrum for the maximum frequency $Fmax_i$ is not sufficient. If an amplitude spectrum for the maximum frequency $Fmax_i$ is not sufficient, an increase of the signal-to-noise ratio is achieved by increasing the duration of the downlinking command. If the duration of the downlinking signal reaches a predefined limit, a more aggressive range of the flap rotation is used. When all options are exhausted, and an energy of white noise is 200 times or more than an energy of signal harmonics, the method comprises lifting a drill bit from the bottom hole assembly.

In accordance with embodiments of the present disclosure, an exemplary system for continuous downlinking communication from a surface location to a bottom hole assembly during drilling operation is provided. The system includes a surface-located fluid line, a pump configured to pump drilling fluid through the surface-located fluid line and through a drill string to the bottom hole assembly, and a modulator coupled to the surface-located supply line and including a flow obstruction component disposed partially in the surface located fluid line. The modulator is configured to generate encoded pressure fluctuations in the drilling fluid flowing through the surface-located fluid line by changing a flow area within the surface-located fluid line with the flow obstruction component. The system includes a mud pulse telemetry system associated with the bottom hole assembly including at least one sensor for measuring formation properties. The system includes a downhole pressure sensor configured to detect the encoded pressure fluctuations generated by the modulator in the drilling fluid. The system includes a downhole controller and processor configured to process and decode downlinking commands associated with the encoded pressure fluctuations. The system includes a main controller in communication with the bottom hole assembly configured to execute the decoded downlinking commands to control drilling operations.

The flow obstruction component can be a flap rotatably disposed within the modulator such that the flap is entirely disposed within the surface-located fluid line. The flap can define a substantially round disc-like shape with a diameter smaller than an inner diameter of the surface-located fluid line. The flap at angular position $\varphi=0°$ provides a minimum restriction to the flow of the drilling fluid through the surface-located fluid line and corresponds to a fully open position in which an open area for drilling fluid flow in the surface-located fluid line is a maximum value. The flap positioned at a rotation angle of ±90° from the angular position $\varphi=0°$ corresponds to a fully closed position in which an open area for drilling fluid flow in the surface-located fluid line is a minimum value.

The modulator is configured to selectively rotate the flap clockwise or counterclockwise in a predefined range of angles of rotation to vary the open area for drilling fluid flow in the surface-located fluid line. Varying a position of the flap generates pressure wave harmonic signals according to selected encoding scheme of a downlinking combinatorial frequencies alphabet. The flap can include female-type mount on opposite edges for coupling to a rotating shaft on one side and connection to a non-rotating shaft on an opposite side. The flap is coupled to both the rotating and non-rotating shafts by pins. The rotating shaft is mechanically connected to a shaft of an electrical motor via a coupling. The rotating and non-rotating shafts are sealed by double mechanical seals with hydraulically balanced friction face-to-face pairs. Sealing of the rotating and non-rotating shafts is complemented by supply of barrier fluid with a 1-3 bars higher pressure than pressure in the surface-located fluid line.

The modulator is coupled to the surface-located fluid line with attachment flanges and crossover subs located on each side of the modulator. The electrical motor is disposed outside of the surface-located fluid line, the electrical motor having a power unit in the form of a battery or power source. Driving of the modulator with the electrical motor is regulated by a motor controller. A main onsite computer transmits through a data exchange device a sequence of letters of the downlinking combinatorial frequencies alphabet which represents an encoded downlinking command. The modulator generates a pressure wave fluctuation in accordance with the sequence of letters of the downlinking combinatorial frequencies alphabet. The electric motor adjusts an angular position of the flap based on feedback control signals to maintain the encoded downlinking command. Control of the electrical motor is performed using hall sensors.

The bottom hole assembly includes at least one sensor capable of identified a presence of drilling fluid flow due to pumping of the drilling fluid by a pump through the surface-located fluid line. Detection of starting of pumping and stopping of pumping of the drilling fluid through the surface-located fluid line triggers a start and end, respectively, of recording of pressure fluctuations by a pressure sensor. The pressure sensor includes a processor, software, circuit boards, and a pressure measuring device. A sensitivity of the pressure measuring device is 0.01 psi or 0.001 psi. The pressure sensor is configured to record, filter, process pressure wave fluctuation, and perform amplitude spectrum analysis using a Fast Fourier Transform.

A controller, processor and software are configured to decode the downlinking command by using pattern recognition of signal frequencies based on Fast Fourier Transform results from calculation on a sliding base. The modulator continuously generates the encoded pressure fluctuations with a harmonic signal with a frequency equal to a maximum frequency $Fmax_i$ before and after downlinking commands. A pressure transducer sensor in the bottom hole assembly is configured to calculate a signal-to-white noise level ratio. The pressure transducer sensor is configured to request through an uplink communication an increase of the signal-to-white noise level ratio if the calculated signal-to-white noise level ratio drops below a predefined threshold level.

An initial signal duration of a single combinatorial alphabet letter T is doubled each time when an uplink request is generated until a new calculated time is less than a predefined $Tmax_1$, where $Tmax_1$ is a maximum duration of time allowed for transmission of one letter, or the signal-to-white noise level ratio is increased using a more aggressive angle of flap rotation. When all options are exhausted and an energy of white noise is 200 times or more than an energy of signal harmonics, the drill bit is lifted from the bottom hole assembly and the single combinatorial alphabet letter T is adjusted by varying the angular position of the flap. A decoded downlinking command type and value is transmitted via internal wires to the main controller of the bottom hole assembly for an execution. A surface sensor real-time information, downhole real-time data, remote center guidance, and onsite operations are processed on the main onsite computer to produce appropriate downlinking instructions to apply the encoded combinatorial alphabet signal schemes at the bottom hole assembly.

Any combination and/or permutation of embodiments is envisioned. Other objects and features will become apparent from the following detailed description considered in conjunction with the accompanying drawings. It is to be understood, however, that the drawings are designed as an illustration only and not as a definition of the limits of the present disclosure.

BRIEF DESCRIPTION OF THE DRAWINGS

To assist those of skill in the art in making and using the method and system for downlinking signal transmission with alphabet frequencies, reference is made to the accompanying figures, wherein.

DETAILED DESCRIPTION

Figure 1:
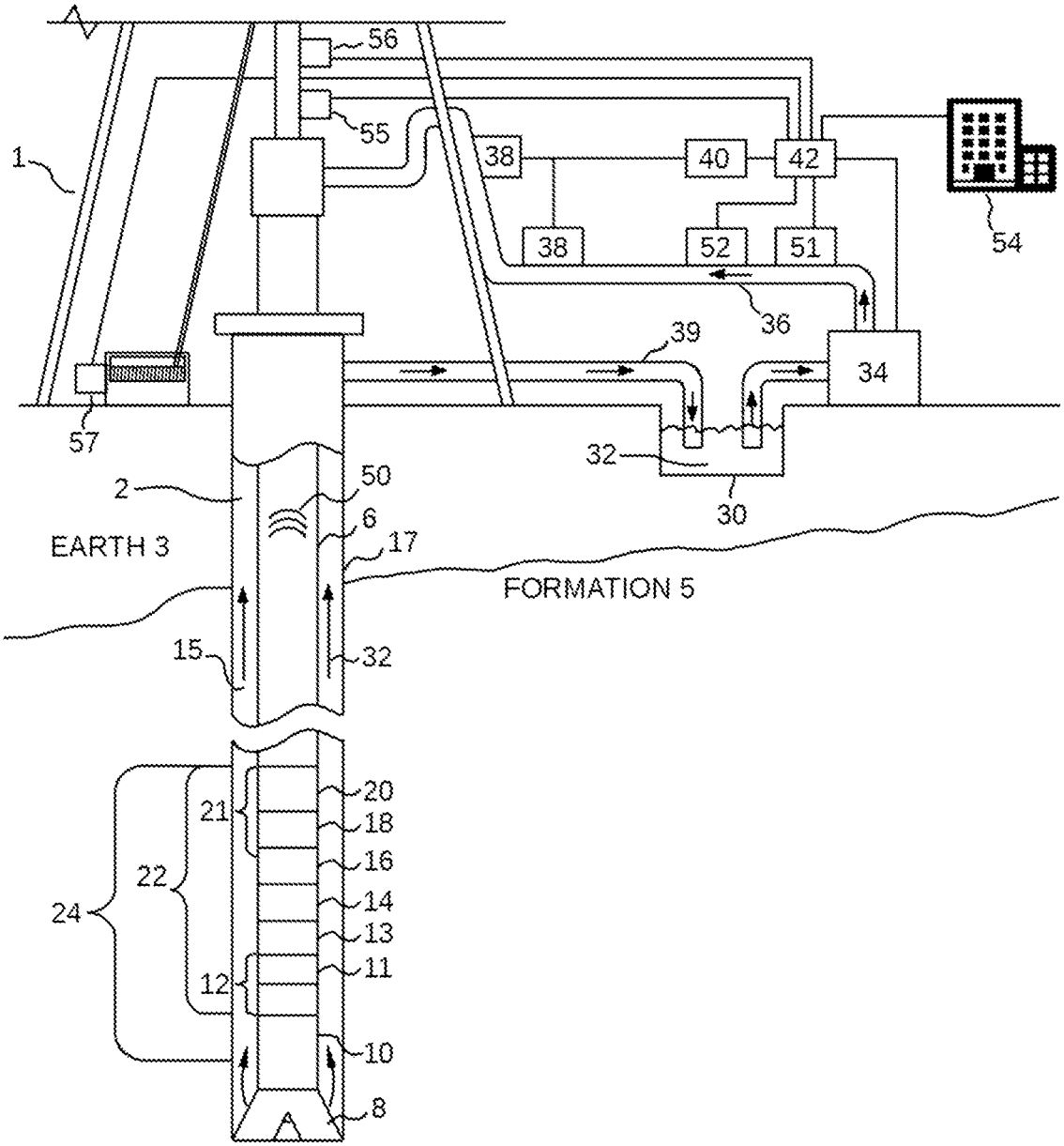
FIG. 1 is a diagrammatic view of a drilling rig with an exemplary system for continually transmitting pressure waves signals to a downhole according to the present disclosure.

FIG. 1 is a diagrammatic view of a drilling rig 1 for implementation of an exemplary system for downlinking communication using a surface based generator for harmonic pressure wave signals. The drilling rig 1 can be engaged in drilling operation with simultaneous logging-while-drilling (LWD) acquisitions and downlinking which can be used for continuous (or substantially continuous) communication between the surface and the bottom hole assembly (BHA) based on transmission of pressure wave signals with different frequencies. As discussed herein with respect to operation of the exemplary signal downlinking transmission system, LWD operation can include both LWD and measurement-while-drilling (MWD) operation, as well as additional measurements. During operation, a well borehole 2 is drilled into the ground 3 through formation 5 by using the rotary drilling rig 1.

Drilling operations generally include the circulation of drilling fluid 32 (e.g. drilling mud) by a pump 34 located at the surface through a mud line 36, into and through a drill string 6 down to the drill bit 8, and back to the surface through the annulus 15 between the drill string 6 and the borehole wall 17. The drilling fluid 32 exits the wellbore 2 via a return conduit 39, which routes the drilling fluid 32 back to one or more mud pits 30. The modulator 51 generates selected or predetermined harmonic pressure waves of the drilling fluid by rotating a flap located inside of the pipe (e.g., mud line 36). The transducer 52 is used by the system to estimate an initial amplitude of the harmonic pressure waves in the drilling fluid for operation of the modulator 51. A controller (e.g., a controller of a computing system located at an on-site location) receives as input the initial amplitude estimate, data from the transducer 52, and the measured pressure changes within the mud line 36 near the modulator 51. If the initial amplitude estimate is inaccurate, software associated with the controller can be used to manually and/or automatically adjust the angle of rotation (e.g., increasing or decreasing the angle of rotation within the modulator 51) to achieve the desired signals.

The BHA 22 at or near the distal end of the drill string 6 can include one or more other sensor modules 12. In some embodiments, sensor modules 12 of the BHA 22 can include one or more flow sensors 11, one or more directional sensors, one or more formation evaluation sensors, combinations thereof, or the like. The BHA 22 includes at least one transducer 13, one or more sources of energy 14 (e.g., batteries or/and generators), and downhole electronics (including a controller 16) in communication with the sensors 12 (including flow sensor 11, transducer 13, and a pulser assembly 21). In some embodiments, the transducer 13 can incorporate an embedded controller that is powerful enough to perform Fast Fourier Transform (FFT) operations in real-time, filtering, detecting and decoding downlinking signals. In some embodiments, the controller 16 communicatively connected to the transducer 13 and other sensors and/or components of the system can perform the FFT operations, filtering, detecting and decoding of the downlinking signals in real-time (or substantially real-time).

The pulser assembly 21 can include a modulator 20, and a motor control and electronic power board 18 (e.g., printed circuit board (PCB)). It should be understood that at least some (if not all) of the components of the downhole assembly can be communicatively connected to each other to allow for signals generated or received by the system to be collectively used for adjusting operation of the system. During operation in the uplink mode, the pressure fluctuation 50 propagate to the surface through the mudflow in the drill string 6 and are detected at the surface by one or more transducers 38 which are connected to the flow line 36. The analog/digital device 40 transmits a digital form of the pressure signals to a processing device or unit 42 (e.g., a computer or some other type of a data processing device). Processing device 42 operates in accordance with software programmed into the system to process and decode the signals received from the analog/digital device 40. The resulting LWD data can be further analyzed and processed to generate a display of various useful information. For example, the system can include a graphical user interface (GUI) capable of displaying data acquired and/or processed by the system during drilling operations. The resulting data can include information related to a confirmation of the downlink command. Such data, viewable at the GUI, can assist with visually confirming proper operation of the system and/or adjusting operation of the system as needed based on operation requirements.

The unit 10 of the BHA 22 in FIG. 1 represents a downhole motor or/and a rotary steerable system (RSS). The fast and frequent communication via the continuous downlinking system described herein allows for timely adjustment of any combination of RSS controllable parameters. For example, with respect to the point of the bit tool, a downlink signal can be transmitted which can have an instruction for a deflection change and a new tool face setting.

A request to downlink to the BHA 22 a downlinking command can be a comprehensive process and a decision which is transmitted in real-time to the surface via an uplink with data from surface sensors (e.g., hook load sensor 56, depth tracking sensor 57, combinations thereof, and the like) along with the well planning trajectory, 3D geological model, mud log information, and others data. All of the above information can be reviewed in real-time (or substantially real-time) by different experts on site or at a remote location 54 in order to make a decision for controlling the drilling process and optimize data acquisition. Based on the comprehensive analysis of the above information, the downhole command can be selected and then transmitted in real-time to the downhole BHA 22. In instances of a high level of noise or the need to switch to lower frequencies (due to an increase of hole depth), the duration of the transmitted signal to the BHA 22 can be increased by up to several minutes, resulting in delay of the adjustment of the drilling process.

Figure 2:
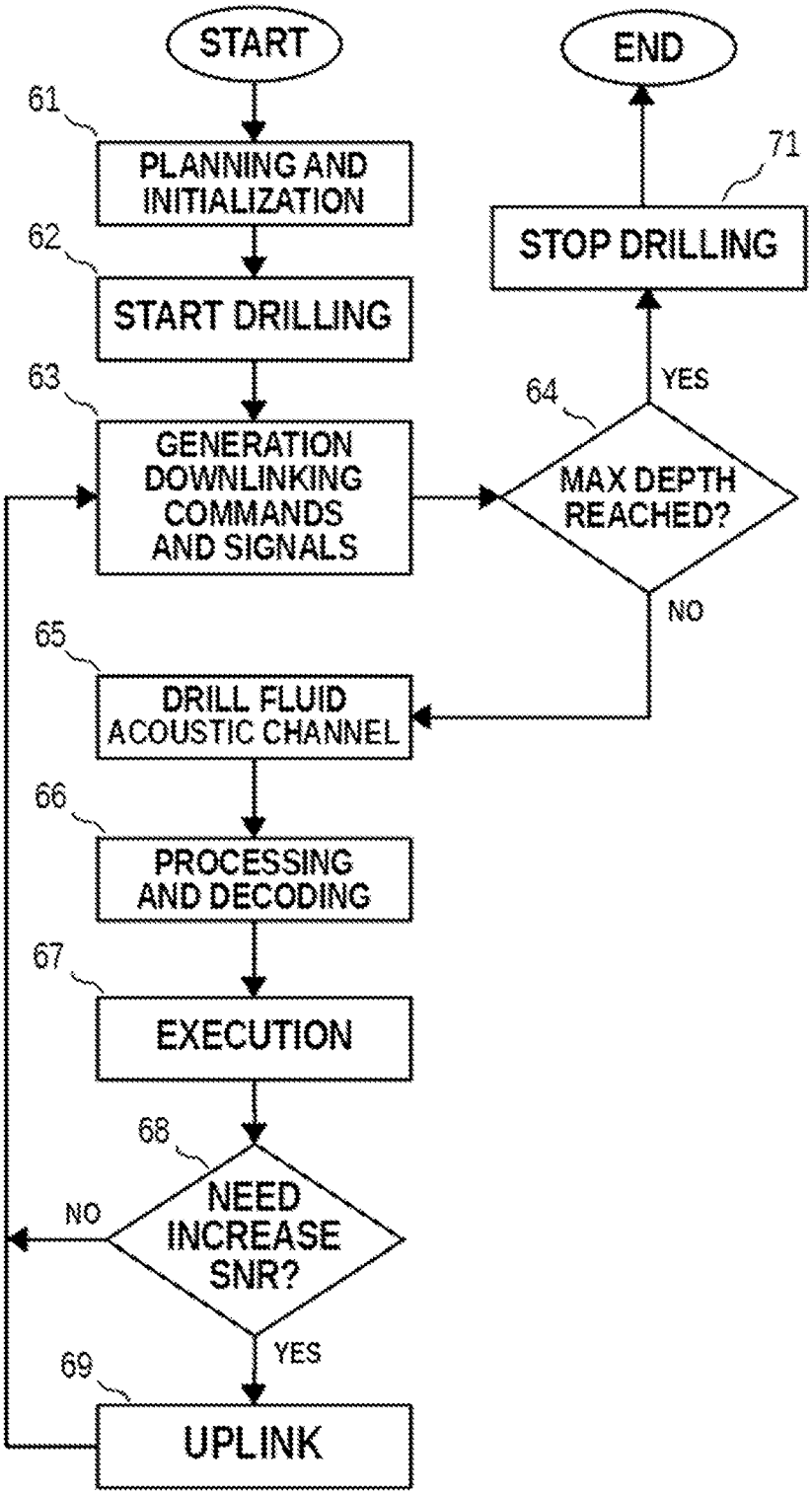
FIG. 2 is a flow chart illustrating a method for downlinking signal transmission with alphabet frequencies according to the present disclosure.

FIG. 2 provides a flow chart with an overview of the method of continuous downlinking as performed by the exemplary system. The planning stage (step 61) includes evaluation of a modulator, determining the list and amount of commands for downlinking, assessment of pressure wave attenuation, determining the frequency range and time for downlinking transmission of harmonic signals, estimation of pressure wave amplitude depending on flap angle $A(\varphi)$, and defining encoding schemas. The initialization stage (step 61) includes establishing and setting parameters for communication between surface sensors, rig site computers, the modulator, and the remote center, as well as programming BHA components, and assembling BHA components.

After the start of the drilling process (step 62), an appropriate downlinking command is selected (manually or automatically) and a corresponding signal is generated by the system (step 63). When the target depth is reached by the drill bit (step 64), drilling is stopped (step 71). If the maximum or target depth is not reached, drilling continues until the target depth has been reached at which point drilling is stopped (step 71). The downlinking signal propagates through the drill fluid acoustic channel (step 65), the parameters of which are determined by the pipe diameter(s) and drill fluid properties (e.g., density, viscosity, or the like). The downlinking command is recorded, processed and decoded (step 66). At step 67, the present invention provides a novel approach to a preventive increase of the signal-to-noise ratio based on sending alerting information during the uplink communications (step 69) in instances of the calculated signal-to-noise ratio being below a predefined threshold level. In particular, the exemplary method includes various options designed to increase the signal-to-noise ratio. After the command is decoded (step 66), the decoded command is executed (step 67). At step 68, if the BHA confirms that the signal-to-noise ratio meets the predefined threshold level, the uplink signal is not transmitted (answer "NO"). However, at step 66, the BHA may confirm that the signal-to-noise ratio does not meet the predefined signal-to-noise ratio. In such case, at step 63, one of the options to increase the signal-to-noise ratio is executed.

Figure 3:
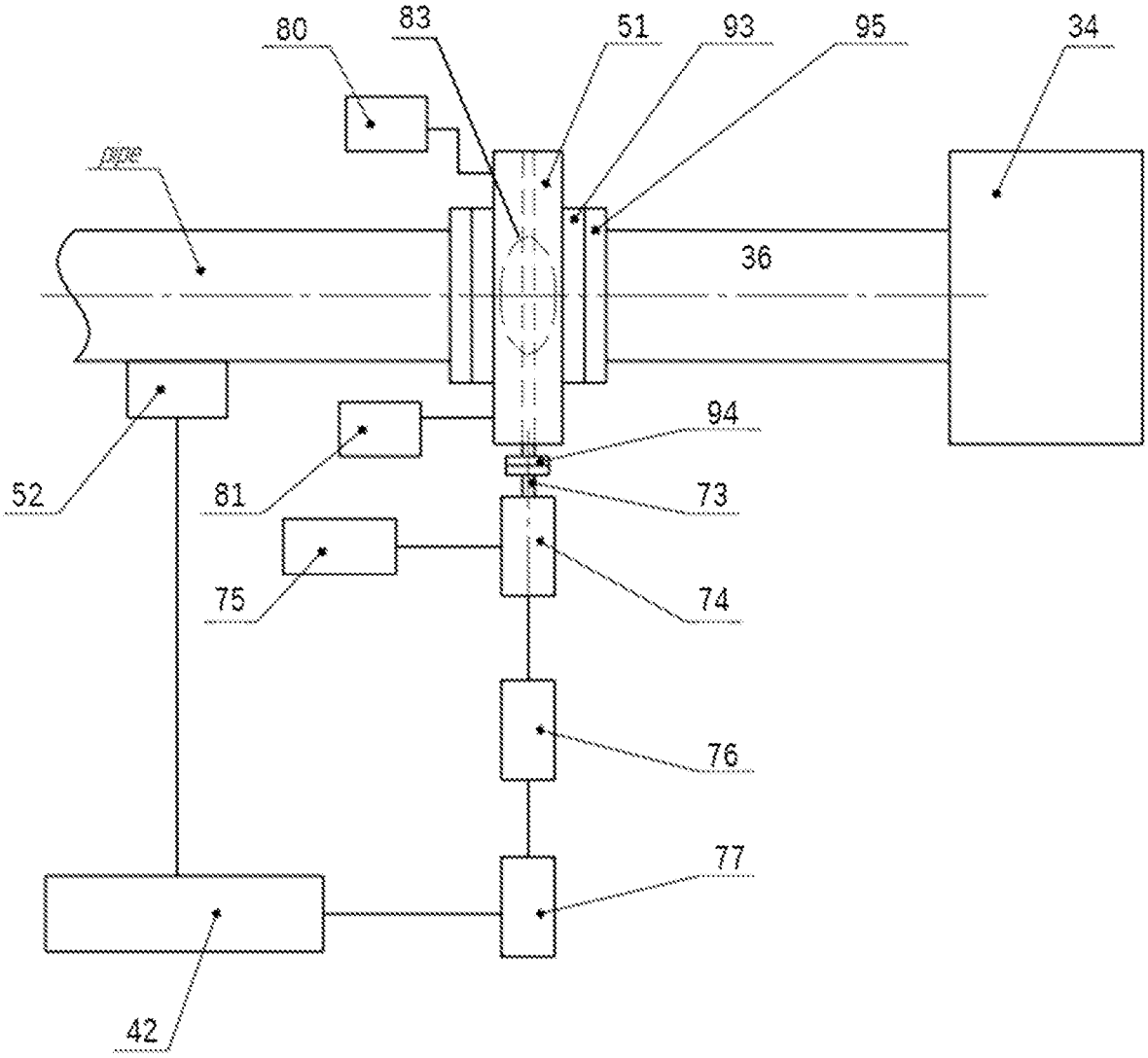
FIG. 3 is a side view of a modulator incorporated into the system for continually transmitting pressure wave signals to downhole pressure transducer according to the present invention.

FIG. 3 shows a diagram of a portion of the drilling rig 1 of FIG. 1 having the continuous downlinking system, including the modulator 51 of harmonic signals in accordance with embodiments of the present invention. The mud line 36 defines a pipe with an outer diameter and having a hollow interior defining an inner diameter through which drilling mud flows. The inner diameter of the mud line 36 therefore defines an area capable of receiving the mud flow. The modulator 51 of harmonic signals is capable of being actuated to restrict the area of the drilling flow within the mud line 36. Pumping equipment 34 regulates flow or pumping of the drilling mud through the mud line 36. The modulator 51 includes an internal flap 83 capable of rotating based on control signals transmitted to the modulator 51, with various angles of rotation of the flap 83 resulting in predetermined restrictions of the area within the mud line 36 area. For example, by rotating the flap 83 clockwise and counterclockwise into one of the predefined range of angles of rotation, the area within the mud line 36 is correspondingly restricted.

The flap 83 is entirely positioned within the mud line 36. The flap 83 position corresponding to angle $\varphi=0°$ provides minimum restriction to the flow of the drilling mud, and the flap 83 position of the rotation angle equal to ±90° (e.g., rotated 90° in either direction from the initial 0° angular position) corresponds to the "shut off" position when the open area for drilling mud flow in the mud line 36 is minimal. For example, the initial 0° angular position can position the flap 83 substantially parallel to the direction of mud flow within the mud line 36, such that the area within the mud line 36 remains substantially unobstructed. If the flap 83 is rotated by 90° in either the clockwise or counterclockwise directions, the flap 83 is positioned substantially obliquely to the direction of mud flow within the mud line 36, thereby obstructing the flow area of the mud line 36 to prevent drilling mud flow through the mud line 36. As would be understood, any angular position of the flap 83 between the 0° and 90° positions would result in a partial obstruction of the area within the mud line 36. Thus, adjustment of the angular position of the flap 83 by the modulator 51 has a direct relationship with the amount of mud flow permitted through the mud line 36.

The harmonic pressure wave modulator 51 is connected to the mud pipe or line 36 by flanges 94 on opposing sides of the modulator 51. In some embodiments, a crossover sub can be used in combination with the flanges 94 for installation of the modulator 51 into the mud line 36 (not shown). The modulator 51 includes seal support systems for supplying barrier fluid to seals 80, 81 to prevent small particles of drilling mud from infiltrating into the sealing system. The modulator 51 is mechanically and operationally connected to a shaft 73 of an electromotor 74 by a coupling 94. The shaft 73 extends substantially perpendicularly to the mud line 36, extending at least partially through the mud line 36 and mechanically coupling to the flap 83 such that rotation of the shaft 73 simultaneously rotates the flap 83. The electromotor 74 is powered by a power source or unit 75. The electromotor 74 is controlled by a control unit 76 (e.g., a controller), which is configured to receive instruction signals for generation of a particular downlinking command from computing device 42 of the system through communication device 77.

Software of computing device 42 takes into account an initial amplitude of harmonic pressure waves generated by the modulator 51 by obtaining pressure measurement signals from transducer 52. If adjustment of the harmonic pressure waves is needed, commands can be input to the computing device 42 which, in turn, actuates the control unit 76 to appropriately actuate rotation of the shaft 73 to reposition the flap 83 within the mud line 36, thereby adjusting the harmonic pressure waves generated by the modulator 51. The transducer 52 subsequently transmits additional signals indicative of the measured harmonic pressure waves based on the new position of the flap 83 and additional control signals for further adjustment of the flap 83 position can be transmitted, if needed.

Figure 4:
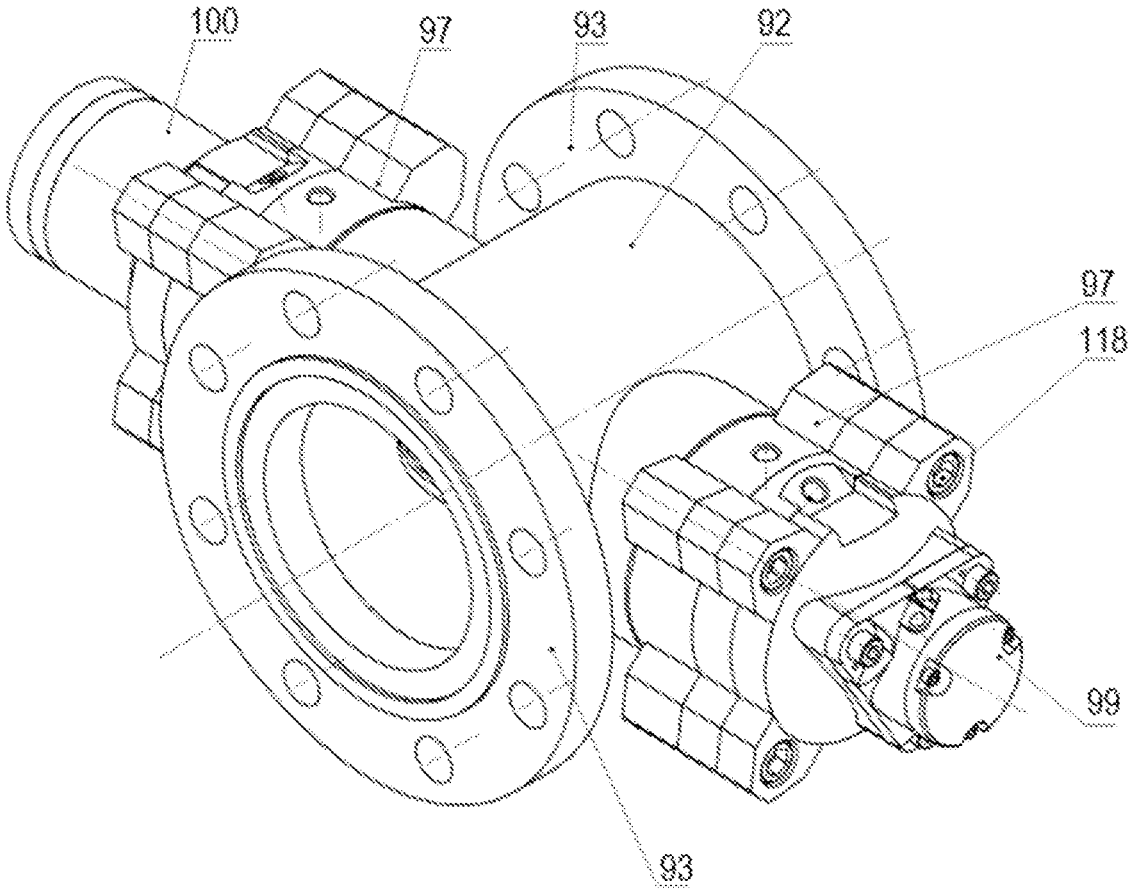
FIG. 4 is a perspective view of a modulator of FIG. 3.

FIG. 4 provides a three-dimensional view of the modulator 51. The modulator 51 defines a generally cylindrical modulator body 92 and attachment flanges 93 extending from opposing sides of the modulator body 92. In the direction substantially perpendicular to the central axis of the pipe defined by the modulator body 92, the modulator 51 includes high-pressure mechanical seals 97 and bearing units 99, 100 on opposing sides of the modulator body 92. The bearing unit 100 can be located on the side of the modulator 51 which is connected to the electromotor 74, and the bearing unit 99 can be located on the opposite side (and can be covered by a blind cover). The modulator 51 includes the flap 83 rotatably disposed within the modulator body 92.

Figure 5:
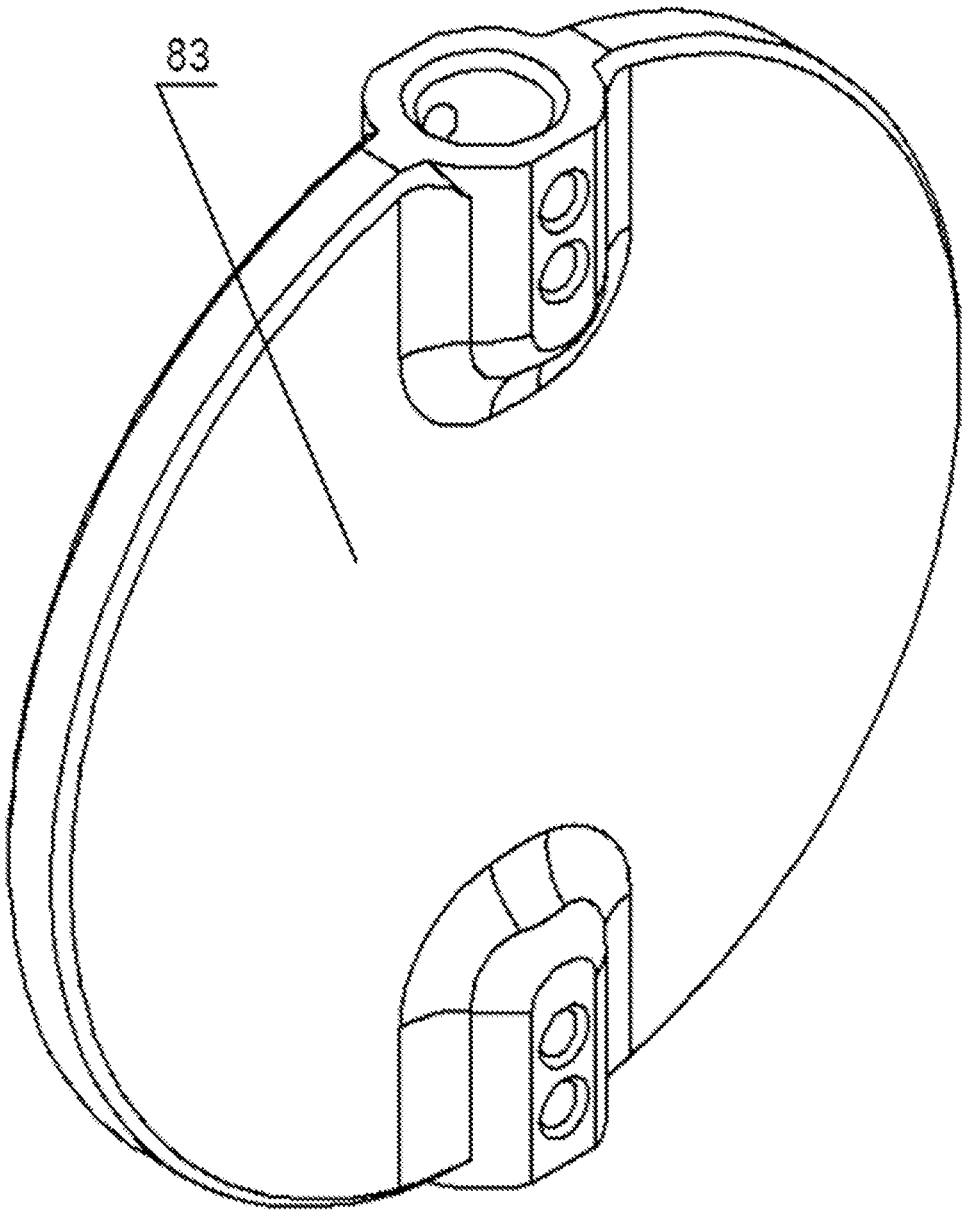
FIG. 5 is a perspective view of an oscillating flap of FIG. 3 disposed in a fluid supply line pipe.

FIG. 5 is a perspective view of the flap 83. The flap 83 can define a substantially disc-shaped body with openings located on opposing sides of the flap 83. The openings can at least partially receive the shaft 73 discussed above such that rotation of the shaft 73 actuates simultaneous rotation of the flap 83. The flap 83 can be fabricated from steel coated by tungsten carbide.

Figure 6:
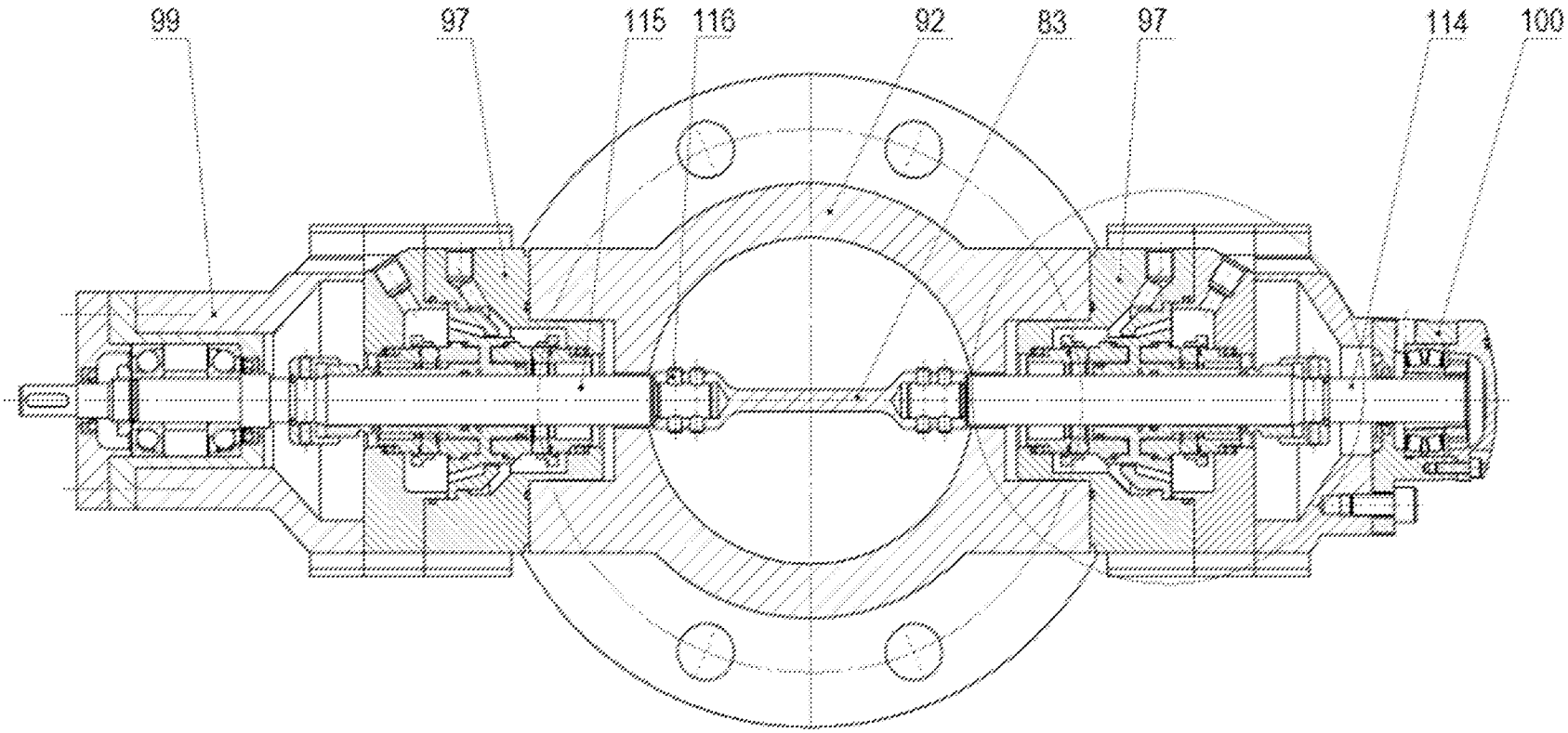
FIG. 6 is a cross-sectional view of a modulator of FIG. 3 in a plane perpendicular to a fluid supply line pipe axis.

FIG. 6 shows a cross-sectional view of the modulator 51 in a plane perpendicular to the pipe axis (e.g., the central axis of the modulator body 92 and the mud line 36). The rotational flap 83 is shown in the horizontal position (e.g., 0°), which corresponds to fully unrestricted drilling mud flow movements. The flap 83 is mechanically coupled to the shaft 114 and to axis 115 by pins 116 and sealing 97, which fasten to the modulator body 92 by screws 118 and bearings units 99,100.

In some embodiments, the sealing 97 (e.g., seal assembly) can include double mechanical seals with hydraulically balanced friction pairs (such as CFFC™ manufactured by AESSEAL® or DHTW™ from FLOWSERVE®). , In some embodiments, a face-to-face sealing solution can be used along with a barrier fluid having a higher pressure (by 1-3 bars) than pressure in the pumping drilling fluid (using a fluid system for supplying fluid to seals 80, 81).

The bearing assemblies include rolling bearings (e.g., SKF®, INA®, and the like) and are generally protected from dust and moisture by elastic element (e.g., a lip seal). Bearings supports can be located in the flanges and can be bolted to the seal 97.

Figure 7:
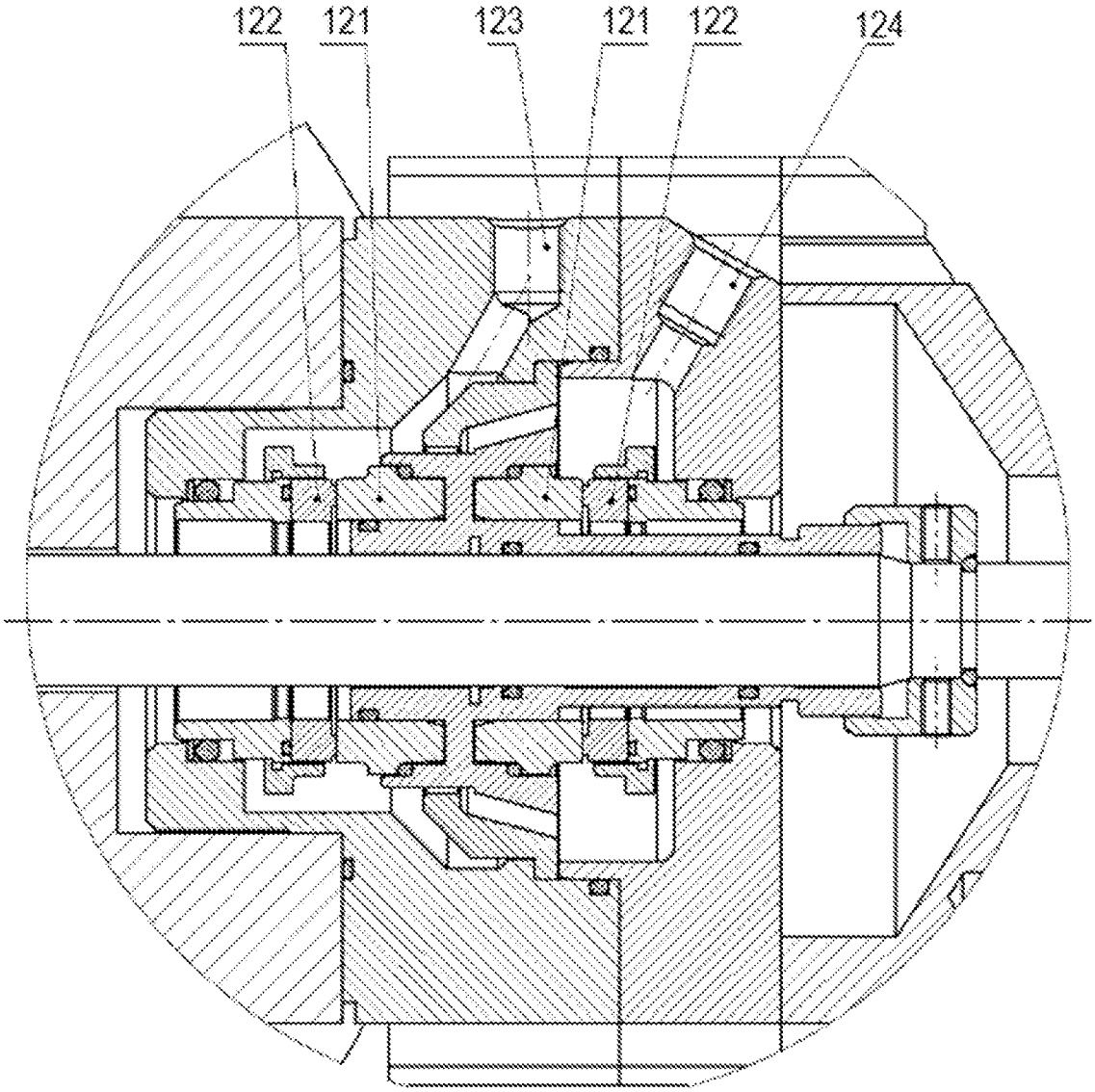
FIG. 7 is a detailed cross-sectional view of a seal for preventing intrusion of pumping fluid into seals.

FIG. 7 shows a detailed cross-sectional of the seal 97 assembly of FIG. 6. Elements 121 are rotational components of the seal 97, and elements 122 are stationary components of the seal 97. In combination, the elements 121, 122 form a friction pair. An opening or hole 123 provides an exit of the barrier fluids and an opening or hole 124 is used for flushing of the seal 97.

All wells generally differ in purpose, design, drilling method, and/or measured depth. Therefore, the planning stage of the process is generally considered essential. The exemplary system and method discussed herein provides the ability to adapt to changing conditions during the drilling process, although planning of work can still be an integral part of the process. The planning stage (step 73 in FIG. 2) is illustrated in greater detail in FIGS. 8-18.

Figure 8:
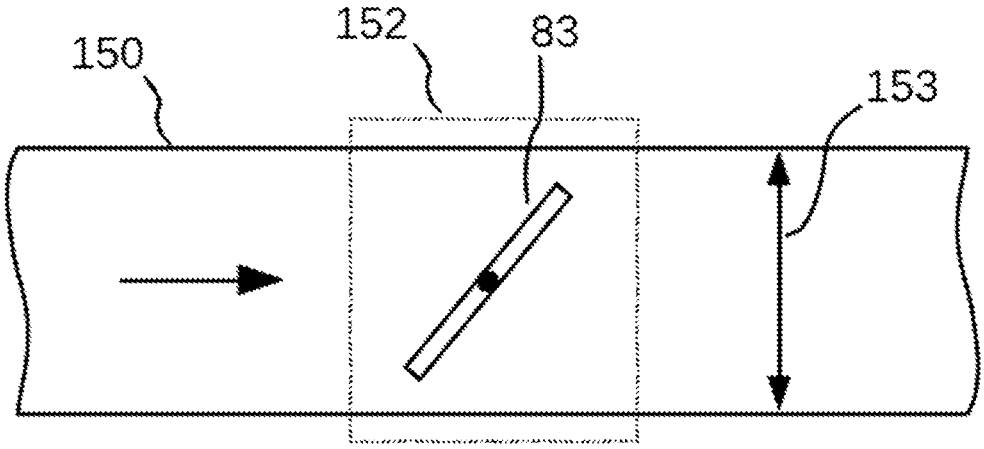
FIG. 8 is a diagrammatic view of a flap of an exemplary system disposed in a fluid supply line pipe.

FIG. 8 shows a diagrammatic cross-sectional view of the fluid supply line or pipe 150 (e.g., mud line 36 of FIGS. 1 and 3) with a flap 83 as part of a flap assembly 152. The inner surface of the pipe 150 is substantially smooth, and the inner diameter 153 extends the circumferential height of the pipe 150. The diameter of the flap 83 is dimensioned less than the diameter 153 of the pipe 150. In some embodiments, the diameter of the flap 83 can be about, e.g., 98-99% inclusive, 98.1-99% inclusive, 98.2-99% inclusive, 98.3-99% inclusive, 98.4-99% inclusive, 98.5-99% inclusive, 98.6-99% inclusive, 98.7-99% inclusive, 98.8-99% inclusive, 98.9-99% inclusive, 98-98.9% inclusive, 98-98.8% inclusive, 98-98.7% inclusive, 98-98.6% inclusive, 98-98.5% inclusive, 98-98.4% inclusive, 98-98.3% inclusive, 98-98.2% inclusive, 98-98.1% inclusive, 98%, 98.1%, 98.2%, 98.3%, 98.4%, 98.5%, 98.6%, 98.7%, 98.8%, 98.9%, 99%, or the like, of the diameter 153 of the pipe 150. The difference in diameter ensures for at least some mud flow through the pipe 150 at all times, while allowing for accurate control of the mud flow with the flap 83. Mud flows through the pipe 150 and encounters the restricted flap 83 operating as a barrier, which reduces the flow area within the pipe 150. A flap 83 rotated into an at least partially restricted position causes a pressure drop in the downstream part of the pipe 150. The rotation angle of the flap 83 determines the size of the barrier and, therefore, the value or magnitude of the pressure drop at the downstream part of the pipe 150. The actuation system (e.g., modulator 51) changes the rotation angle of the flap 83 to produce pressure waves. In order to estimate a magnitude and a form of the signal produced by the system of the pipe 150 and the flap 83, the absolute pressure values were calculated for different rotational angles of the flap 83.

Different rotational positions of the flap 83 effectively result in different flow areas through the pipe 150. For example, with the flap 83 oriented substantially perpendicularly to the flow direction, the smallest flow area in the pipe 150 is achieved. As a further example, with the flap 83 oriented substantially parallel to the flow direction, the largest flow area in the pipe 150 is achieved. The relationship between the flap 83 position and pressure in the pipe 150 can be obtained on the flow loop and/or by using numerical simulation methods. The same effect can be achieved without the flap 83 by using a narrowed segment 154 of the pipe 150 having a diameter 155 resulting in a restricted area 155 corresponding with the flow area created by the flap 83. As an example, for numerical simulation, a flap 83 (shown in FIG. 8) was substituted by a short, narrowed pipe segment 154 (shown in FIG. 9). A short segment of the pipe 150 containing the flap assembly 152 is replaced by the narrowed segment 154 of the pipe 150. As noted above, changing the rotational angle of the flap 83 is substantially equivalent to setting a different inner diameter 155 at the narrowed segment 154 of the pipe 150 to create a simplified model for calculation of estimated absolute pressure values. Each rotational angle of the flap 83 corresponds to a particular diameter 155 value of the narrowed pipe, resulting in the same flow area. Estimations of the pressure drop were calculated for each particular diameter of the narrow pipe segment 154 to determine values equivalent to the pressure drop caused by the flap 83 in each of the respective rotational or angular positions φ.

Pressure values can be obtained via numerical simulation methods implemented in multiphysics engineering software (e.g., ANSYS®, COMSOL® Multiphysics, or the like) using a module for computing the velocity and pressure fields in pipes and channels of different shapes. Such software can calculate the pressure and velocity of an incompressible or weakly compressible fluid by solving the continuity and momentum equations (Equations 1 and 2 below) for flow in a pipe (See, e.g., C. L. Barnard et al., "A Theory of Fluid Flow in Compliant Tubes", Biophysical Journal, vol. 6, no. 6, pp. 717-724, 1966):

$$\rho\frac{\partial u}{\partial t} + \rho u \cdot \nabla u = -\nabla p - f_D \frac{\rho}{2d_h} u|u| + F \tag{1}$$

and $$\frac{\partial A\rho}{\partial t} + \nabla \cdot (A\rho u) = 0 \tag{2}$$

where u represents the cross-sectional averaged velocity, ρ represents the density, p represents the pressure, $f_d$ represents the Darcy friction factor, F represents a volume force, $d_h$ represents the hydraulic diameter, and A represents the pipe cross-sectional area.

Figure 9:
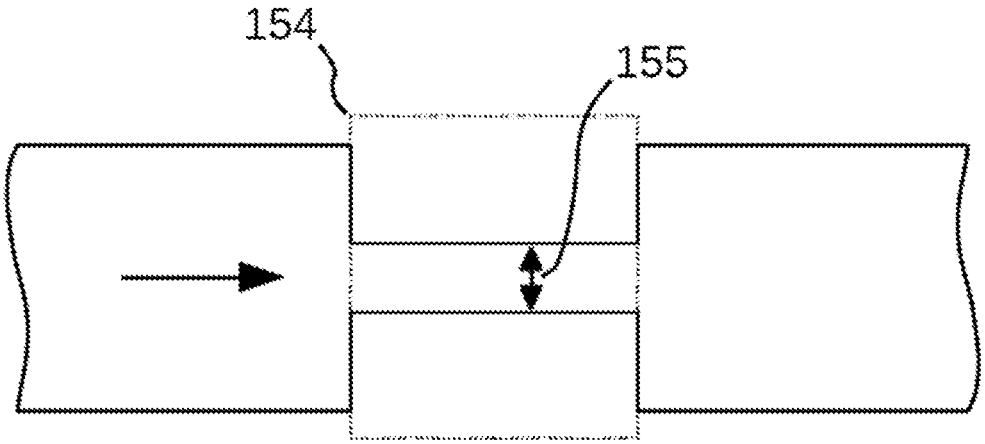
FIG. 9 is a diagrammatic view of a substitution for a flap by a smaller diameter pipe during numerical simulation of a restriction of mud flow on an amplitude of pressure wave signals.

Building models for different diameters from $D_{min}$ to $D_{max}$ of the pipe segment of FIG. 9 and further calculations in simulation software provided the estimated absolute values of pressure drop in the downstream part of the pipe. Finally, the correspondence between the diameter of the pipe and the rotation angle of the flap was used to determine and correlate how the pressure drop depends on the rotational angle of the flap (FIG. 11).

Figure 10:
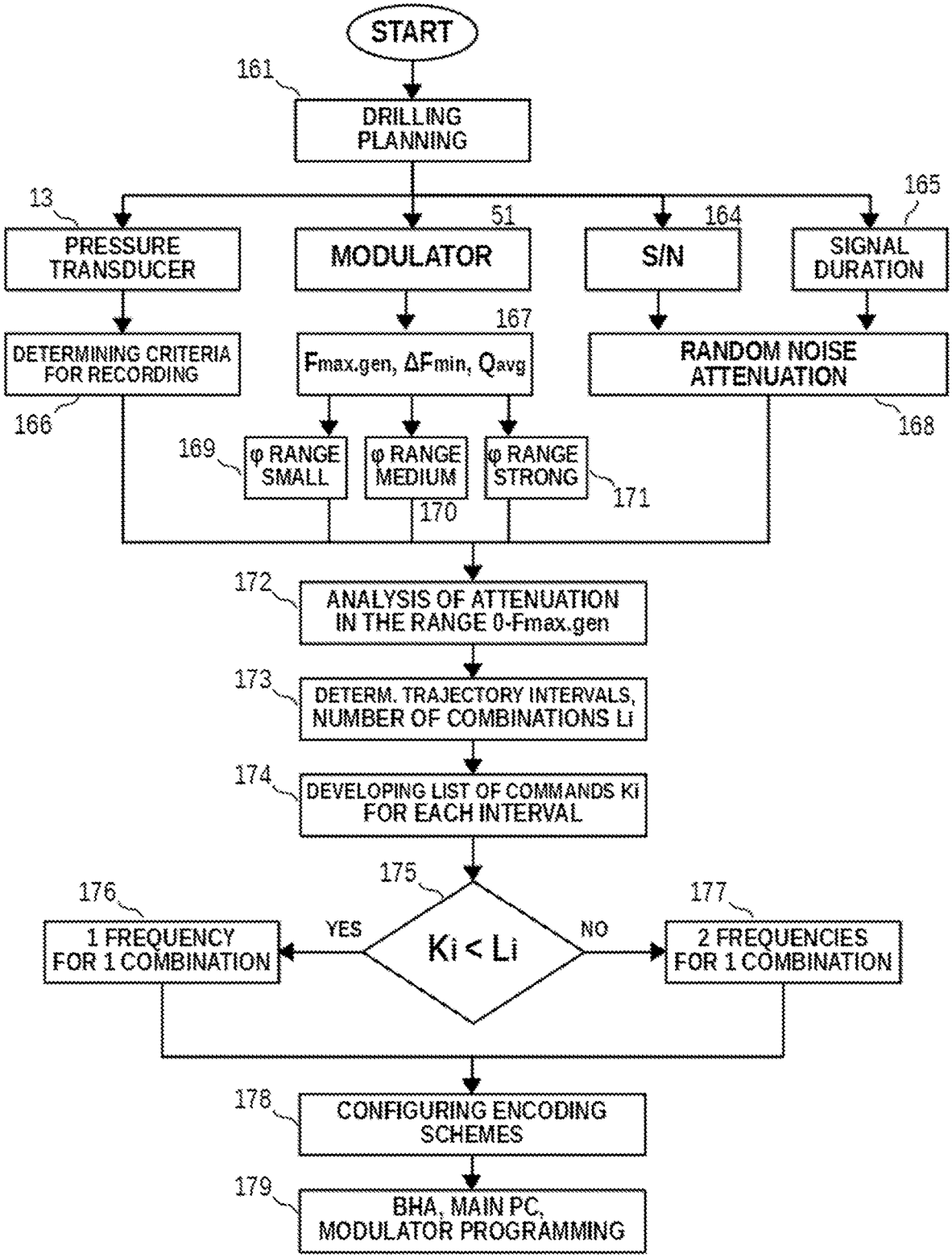
FIG. 10 is a flow chart illustrating steps and their sequence during planning and initialization phases according to the present disclosure.

FIG. 10 is a flow chart and block diagram illustrating steps for the planning and initialization stage (step 161). Transducer 13 necessitates determining criteria for recording 166. The system estimates the following parameters: the maximum frequency $F_{max.mod}$ of the modulator 51, the minimal difference between adjacent frequencies $\Delta f_{min}$, and the average flow rate $Q_{avg}$ (values 167). $F_{max.mod}$ can be determined by the maximum number of revolutions per minute or second reduced by the gear ratio of the gearbox, the range of rotation angles, and taking into account the losses of time for acceleration and deceleration (discussed in detail below). If the range of angles is small (e.g., about 10-12 degrees), then the influence of deceleration and acceleration will be stronger. If the range of angles is large (e.g., about 40-50 degrees), then a decrease in $F_{max.mod}$ will be mainly due to the fact that the path will increase (e.g., 40 degrees×2 in each direction). As an example, in one instance the path can be 20 degrees, and in the second instance the path can be 80 degrees, but the frequency decrease will be four times and about only two times, respectively, since the acceleration and deceleration losses in the second instance would play a lessor role. The determination of $F_{max.mod}$ can be made for different ranges (e.g., 10, 20, 30, 40, 50 degrees) based on experimentation with a specific motor and gearbox. $\Delta f_{min}$ can be determined experimentally. For the system discussed herein, the value for $\Delta f_{min}$ can be about 0.125 Hz, being residual and reliably provided by the modulator. $Q_{avg}$ is the average flow rate taken from the drilling plan. Estimation of the signal-to-noise ratio 164 and signal attenuation 172 allows for determination and selection of a proper signal duration 165 and random noise attenuation 168. Attenuation 172 can be determined by Equation 3 (below). The system ability for detection of useful harmonic signal frequency is 100 or more times higher. An ability of the system and method to detect useful harmonic signal is based on using longer duration of the downlinking signal in the presence of the strong random noise. With an increase in the signal duration by N times, the signal-to-noise ratio 164 increases in amplitude by IN, and in energy by N times. (See, e.g., FIG. 15). The estimated noise-to-signal ratio 164 can be determined by analyzing the pressure transducer data recorded in the memory during MWD/LWD operations in the proposed area. In the course of drilling operations, constant (or substantially constant) monitoring and determination of the signal-to-noise ratio 164 is carried out by the system. In some embodiments, the controller and/or processing device of the system performs such monitoring and determination of the values discussed herein for accurate control/regulation of the system.

Figure 12:
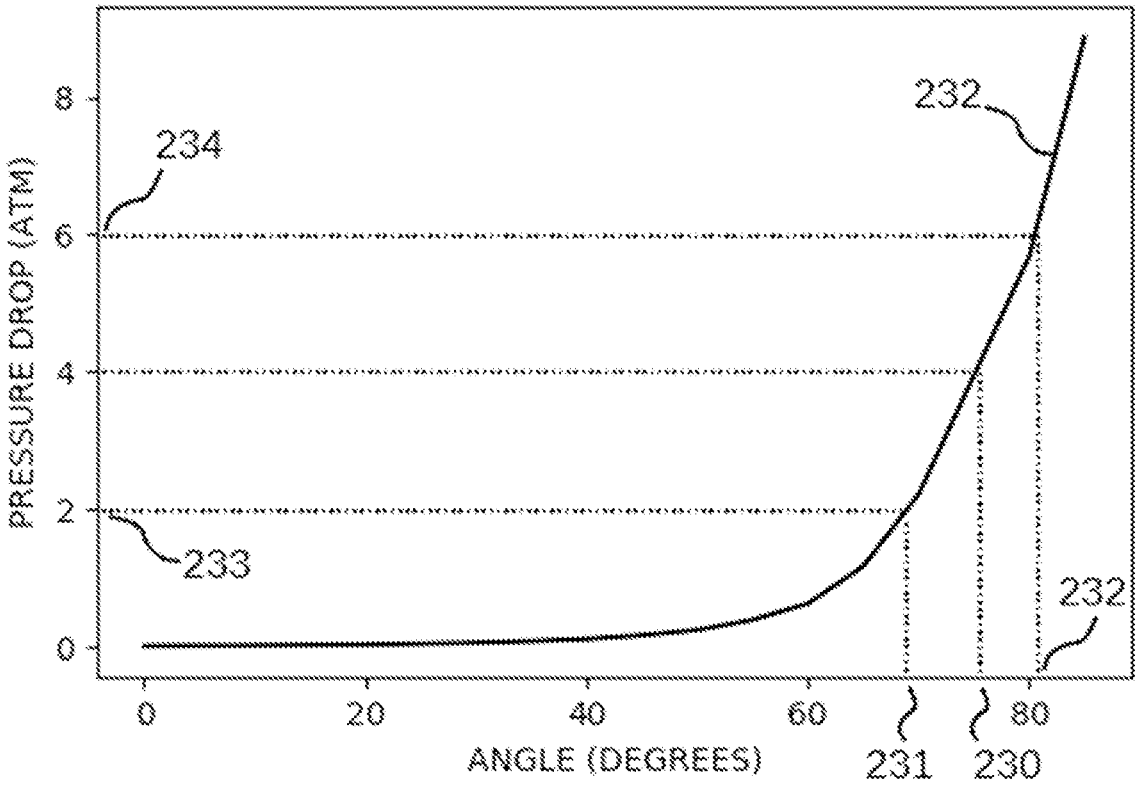
FIG. 12 shows a graph for selection of oscillating rotation range of angles for a flap with a round shape.

The flap disposed within the modulator 51 can operate in three different ranges of angles: small range 169, medium range 170, and maximum or strong range 171. The small, medium and large angle values also correlate with amplitude values. For example, as illustrated in FIG. 12, an angle range from 55-70 degrees may generate a pressure drop amplitude of about 2 atm. For a medium range of about 60-77 degrees and for a maximum range of about 75-85 degrees, the pressure drop amplitude can be about 6 atm. In general, at the start of drilling and up to a particular depth, the system can ensure a small pressure drop amplitude in order to minimize an obstruction of the drilling flow. In order to improve the signal-to-noise ratio, the increase of signal duration time T can be used. When T is about 5-7 minutes, an option to increase amplitude by using a different range of angles of rotation can be applied by the system. The selection of a rotational range of angles to each interval of measured depth can be linked within software of the controller for the system. Thus, for each interval, smaller angles used result in smaller amplitude and larger areas of drilling mud flow, then the signal duration time T is increased to improve the signal-to-noise ratio, and afterwards the amplitude can be increased by restricting the flow area (see, e.g., FIG. 25, step 619). Analysis of the attenuation in the maximum frequency $F_{max.gen}$ range is performed (step 172). The planning trajectory is split into intervals by measured depth, and the number of combinations is calculated (step 173). For each interval the list of commands Ki is determined (step 174). If the number of combinations exceeds the number of commands (step 175), then the combination of command function and value is transmitted via one frequency as a single letter of the combinatorial frequencies alphabet (step 176). If the number of combinations is smaller than the number of commands (step 175), then the combination of command function and value is transmitted via two frequencies as two letters of the combinatorial frequencies alphabet (step 177), the first letter for the command type, and the second letter for the command value. All encoding schemes are configured (step 178) and programmed (step 179) into the BHA, main computing device and/or modulator controller of the system.

Figure 11:
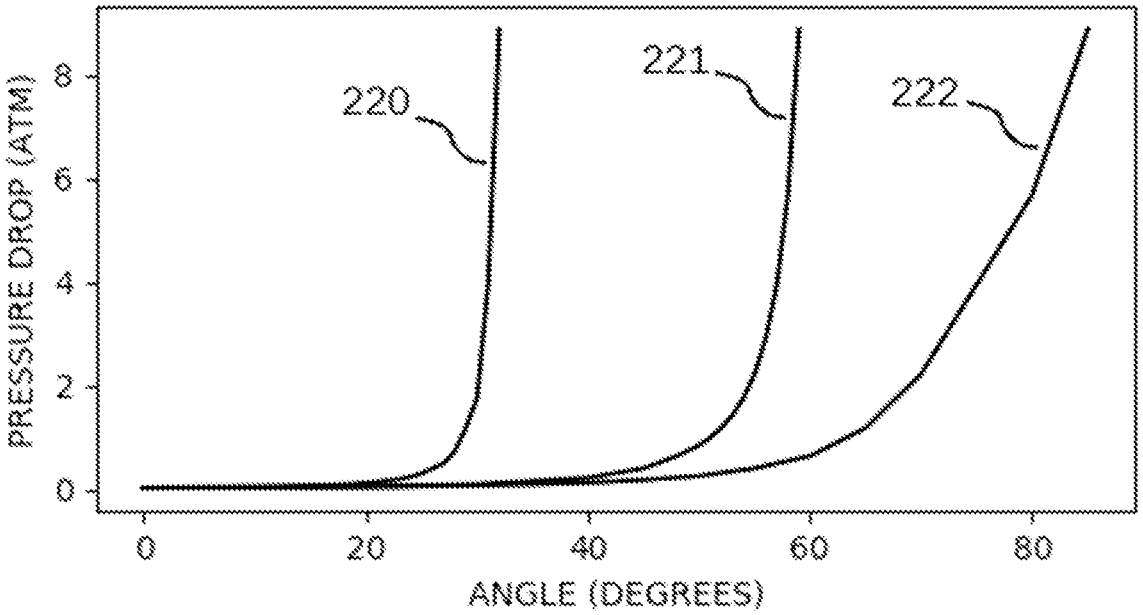
FIG. 11 shows graphs of negative amplitude of pressure waves for different rotational angle positions for three types of flap shapes.

FIG. 11 shows the pressure wave amplitude values versus the flap angle calculated (e.g., estimated) using the method described above for three types of the flaps: long oval 220, short oval 221 and a circle flap 222. Calculations performed for a pipe with an inner diameter of 103 mm, a flow rate of 20 l/s, and a density of 1 g/cm$^3$ were performed. Each shape of the flap provided a different resulting effect on pressure changes with changes in the angle of the flap. The long oval flap 220 closes the pipe at the rotation angle 30° with significant pressure change (from 1 to 8 atm) in the small angle range from 27° to 30°, whereas the rotation in the range from 0° to 20° does not cause visible changes in the pressure. For the circle flap 222, a complete shut off of the pipe occurs at the angle 90°. A gradual growth of pressure from 1 atm to 8 atm occurs in the angle range from 60° to 90°. The result for the oval flap 221 is in the middle between the long oval flap 220 and the circle flap 222. The fast pressure growth for the oval flaps 220, 221 near the cut-off angle would require usage of a short range of working angles $\varphi_{min}$, $\varphi_{max}$. Therefore, based on modeling and the results in FIG. 11, the optimal shape of the flap may be a circle flap 222. A wide range of working angles result in the system being less sensitive to rotational inaccuracy that may be caused, for example, by system inertia.

FIG. 12 illustrates examples of a working range of angles of the circle flap. The restricted flap operates in the range of angles $\varphi_{min}$ (231) $\varphi_{max}$ 232) starting from an initial position $\varphi_0$ (230). This does not necessarily mean that the zero position $\varphi_0$ must be located at a center of the range $\varphi_{min}$, $\varphi_{max}$. Instead, the $\varphi_0$ value depends on the shape of the function 232. The flap turns clockwise and counterclockwise with a required rotational speed producing the desired form of pressure waves. The controller calculates the required exact position of the flap at any specific time based on the frequency of the generating signal. The range of angles $\varphi_{min}$, $T_{max}$ is selected based on the required amplitude of the pressure wave calculated as half of the difference between pressure levels 233, 234. In this example, the double amplitude equals 4 atm, $\varphi_{min}$=68° (231), $\varphi_{max}$=81° (232). Expanding of the angles range to $\varphi$=65° and $\varphi_{max}$=82° increases the double amplitude to 6 atm (in 1.5 times), but it leads to reduction of the angular frequency that depends on the oscillation range and maximum angular velocity of the motor.

The highest frequency $F_{gen.mod}$ of the signal produced by the modulator is determined by an implementation of the mechanism transmitting motor torque through the reduction gear box to the flap or using the motor to rotate the flap without a reduction gear box. Such frequency could be estimated using the motor speed, gear ratio of the reduction gear box, and working range of angles $\Delta\varphi$. For example, a system with a motor having 1500 RPM and a reduction gear box ratio of 5:1 would result in 300 rotations per minute (or 5 rotations per second), which equals 360*5=1800 degrees per second. For a range $\Delta\varphi$=10° maximum generator frequency equals $F_{gen.mod}$=1800/(10*2)=90 Hz. Damping effects arising from the bidirectional rotation decrease this value 1.8-2 times. Based on these calculations, for further illustration of the method, $F_{gen.mod}$ is assumed equal to equal 45 Hz.

The signal generated by the modulator 51 according to the encoding/decoding scheme 73 propagates in the form of harmonic pressure waves inside of the drill fluid acoustic channel. In the process of propagation, the amplitude of the downlinking signal decreases tens (or even hundreds) of times. Such signal attenuation generally restricts application of at least some of existing downlinking systems. For example, a detection of individual negative pulses is generally feasible only by using expensive and bulky equipment, and large pulses with an amplitude of 300-600 psi which negatively affect mud pump operation. The exemplary system and method allows for use of pressure wave harmonics with an amplitude of 30-60 psi to detect signals with a small amplitude.

The attenuation of the signal increases with the smaller internal pipe diameter, resulting in greater compressibility and higher viscosity of the drilling fluid, with higher signal frequencies, and greater measured depth of the well. The effect of the attenuation can be calculated by using Equation 3 below (See, e.g., Lamb, H., Hydrodynamics, Dover, New York, N.Y., pp. 652-653 (1945)):

$$P = P_0 \exp\left[-4\pi f\left(\frac{D}{d}\right)^2\left(\frac{\mu}{K}\right)\right] \quad (3)$$

where, P represents the signal strength at a surface transducer; $P_0$ represents the signal strength at the downhole modulator; f represents the carrier frequency of the MWD signal; D represents measured depth between the surface transducer and the downhole transducer; d represents the inside diameter of the drill pipe; μ represents the plastic viscosity of the drilling fluid; and K represents the bulk modulus of the volume of mud above the modulator.

Figure 13:
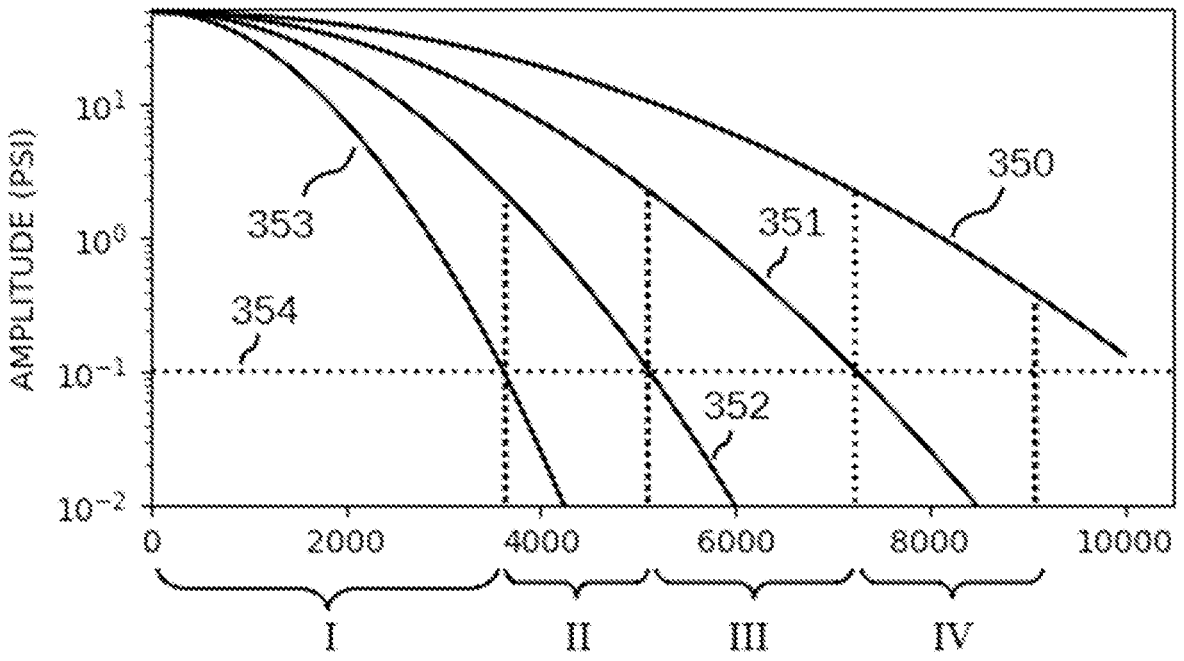
FIG. 13 shows a graph with examples of attenuation for different frequencies and a division of a well trajectory into sections.

FIG. 13 shows the amplitude attenuation (in logarithmic scale) for harmonic frequencies of 5 Hz (350), 10 Hz (351), 20 Hz (352), and 40 Hz (353) versus measured depth calculated for a 121 mm outer diameter pipe and oil-based mud. In order to select an appropriate range $F_{min}$–$F_{max}$, the minimal detectable level of signal amplitude was estimated. The typical pressure sensitivity while drilling for sensors is about 0.01 psi. Transducers (e.g., Quartzdyne) with a sensitivity of up to 0.001 psi could be used in some specific instances.

FIG. 13 illustrates an example for drilling a deep well (about 9 km depth) and a standard pressure sensor with sensitivity of 0.01 psi. For a reliable signal detection with such sensitivity, the amplitude of the signal should be equal or greater than 0.1 psi (line 354). Depth of the point where the line 354 intersects the amplitude attenuation curves is a maximum depth at which signal amplitude is equal to 0.1 psi. Using this value as a minimum allowable level of signal, downlinking signals can be reliably detectable at: I) for range 2-40 Hz, up to a depth of about 3600 m (353); II) for range 2-20 Hz, up to a depth of about 5100 m (352); III) for range 2-10 Hz, up to a depth of about 7200 m (351); and IV) for range 2-5 Hz, up to a depth of about 9000 m (350). The above-mentioned example shows a maximum measured depth for various frequency components that still provides reliable detection of harmonics with an amplitude 0.1 psi (a double amplitude of 1 psi). The following example illustrates the possibility of reliable harmonic detection if white noise is present due to operations of drill bit, downhole motor, and/or fluid movements.

Figure 14A:
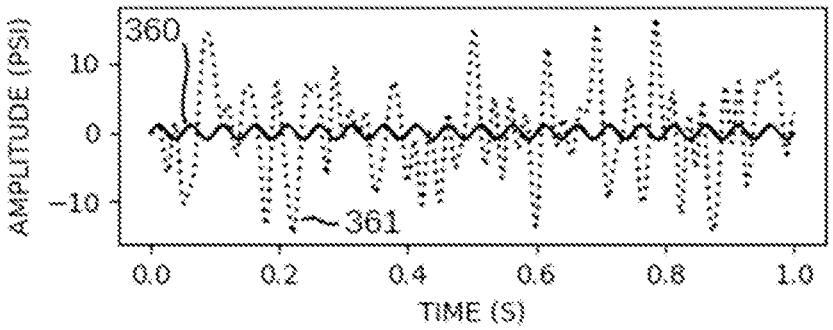
FIG. 14A shows a weak signal F=20 Hz against a white noise with energy 100 times greater than the signal.
Figure 14B:
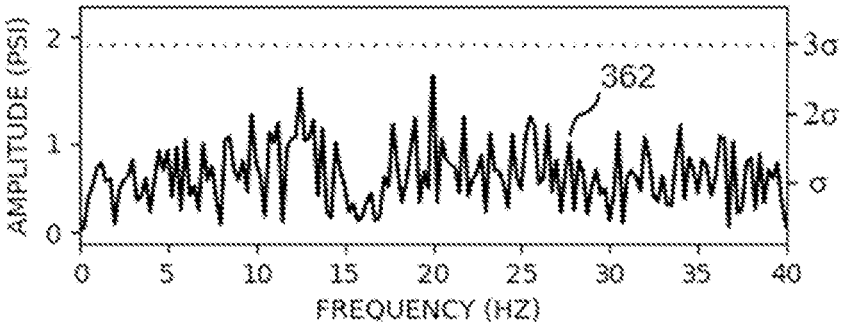
FIGS. 14B-14E show results of Fast Fourier Transform for different time windows equal to 8 seconds (FIG. 14B), 16 seconds (FIG. 14C), 32 seconds (FIG. 14D), and 64 seconds (FIG. 14E).
Figure 14C:
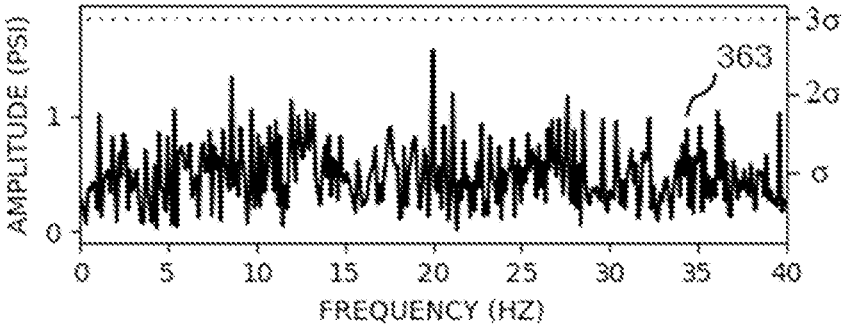
Figure 14D:
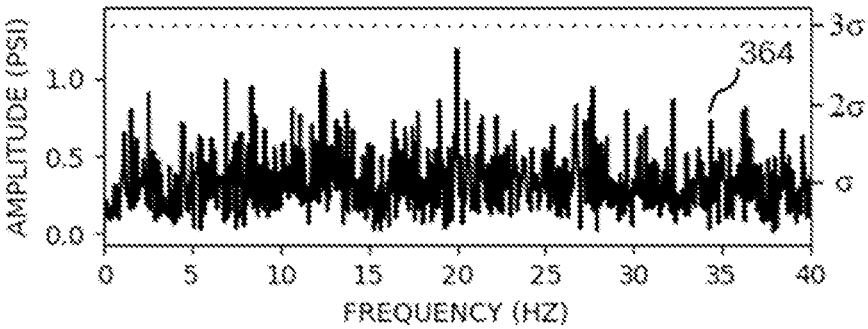
Figure 14E:
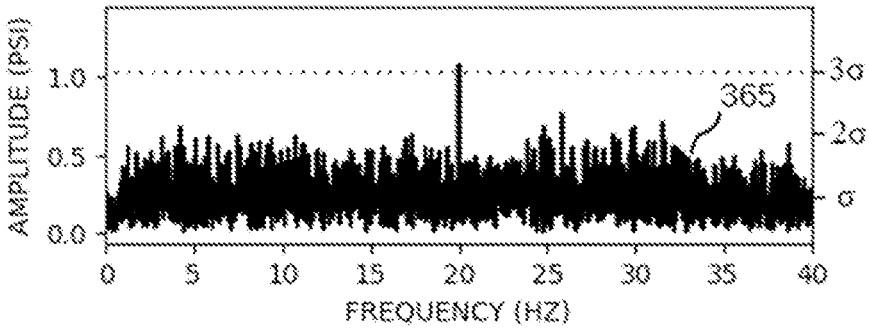

FIG. 14A shows a 20 Hz signal 360 and white noise 361. The energy of the noise is 100 times greater than the signal energy. FIG. 14B shows the FFT spectrum line 362 for the duration of the signal T=8 s. FIG. 14C shows the FFT spectrum line 363 for the duration of the signal T=16 s. FIG. 14D shows the FFT spectrum line 364 for the duration of the signal T=32 s. FIG. 14E shows the FFT spectrum like 365 for the duration of the signal T=64 s. The FFT spectrum line 362 for T=8 s shows that detection of the 20 Hz frequency component is not possible because the amplitude of 20 Hz is suppressed by different amplitudes of random noises (3, 7, 15, 24, 29 Hz). The FFT spectrum line 363 for T=16 s and the FFT spectrum line 364 for T=32 s provide visible detection of the 20 Hz frequency component, but does not meet a detection criteria A signal>3*$\sigma_{noise}$, where B noise is a standard deviation of the amplitude spectrum of white noise in an operating frequency range of $F_{min}$–$F_{max}$. Such criteria provides more than 99% probability of correct detection. The increase in duration T by N times allows for surpassing of noises by the rule $\sqrt{N}$. In one embodiment, the detection criteria can be A signal>3*$\sigma_{noise}$, where $\sigma_{noise}$ is a standard deviation of the amplitude of white noise in the operating frequency range $F_{min}$–$F_{max}$. In practice, with the exception of a depth 5 km or higher, reliable detection is feasible for T=8, 16 or 32 seconds. However, if the noise exceeds the signal by 100 times, these durations are not enough (as shown by FIGS. 14B-D).

Figure 15:
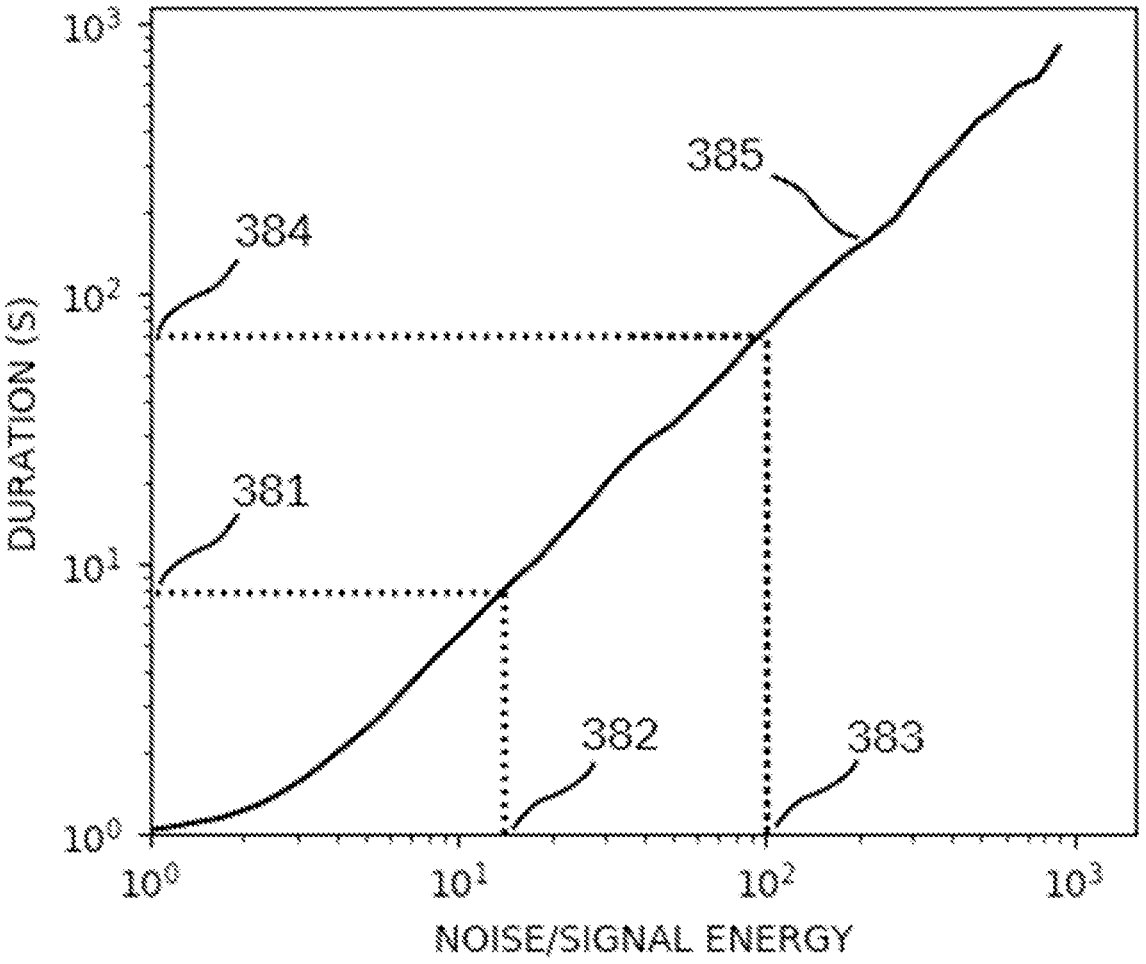
FIG. 15 shows a graph between white noise to signal ratio and a duration of a signal sufficient for reliable detection and decoding of a downlinking signal.

FIG. 15 illustrates the signal duration required for signal detection versus the noise-to-signal energy ratio. Duration T=8 s (381) allows for detection of the signal if the noise-to-signal energy ratio is less than or equal to 14 (382). If the noise-to-signal ratio equals 100 (383), the condition A signal>3*$\sigma_{noise}$ is met for duration T=60 s (384) or longer (as illustrated by spectrum line 365 of FIG. 14E).

Figure 16A:
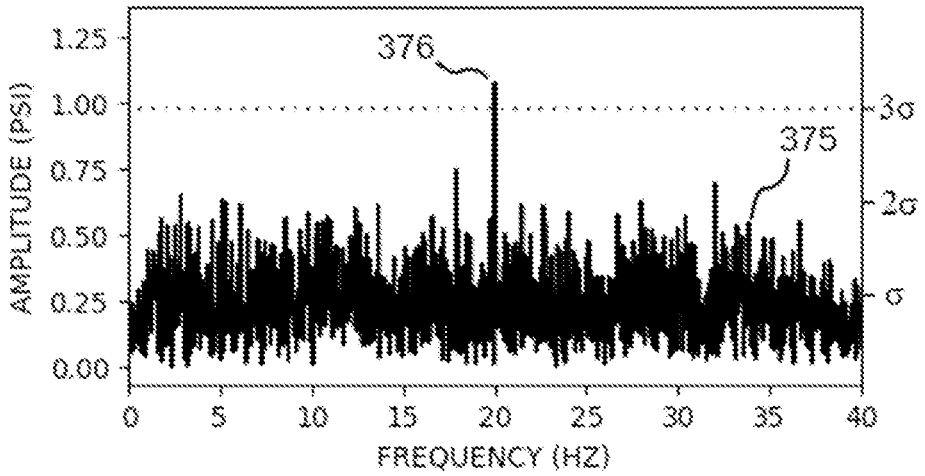
FIGS. 16A and 16B show graphs that indicate that the time duration for the above example of white noise 100 stronger than a downlinking signal should be equal to 64 sec.
Figure 16B:
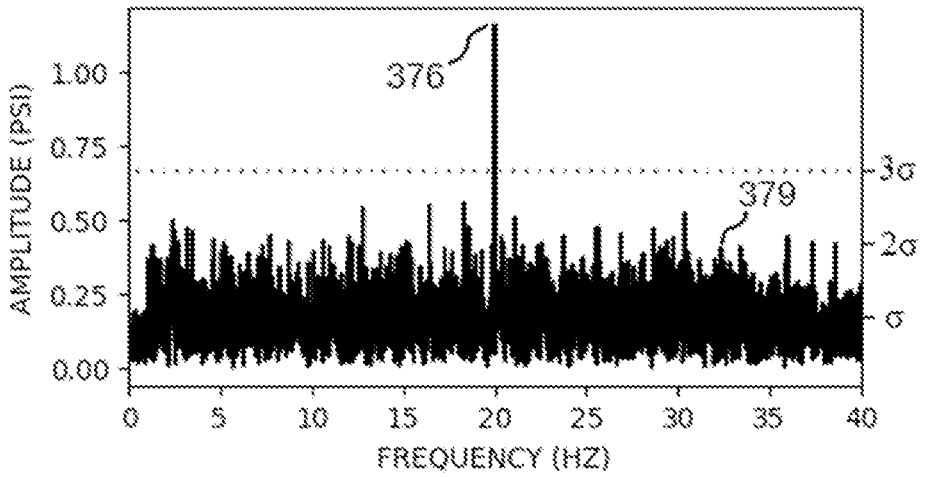

FIG. 16A illustrates the same example for T=64 s (375) and T–128 s (379). The amplitude of the 20 Hz component (376) is higher than three standard deviations σ of the white noise (375). The equation A signal>3*$\sigma_{noise}$ represents a threshold of robust signal detection. In accordance with the theory of useful signal accumulation against the background of white noise, an increase of the duration by N times causes an increase in the signal-to-noise amplitude ratio by $\sqrt{N}$ times. If signal-to-noise ratio must be increased two times, it is necessary to increase the duration by four times. The second plot (379) in FIG. 16B shows that a further increase of the duration T provides better detectability of the signal component (376), but it is redundant, i.e., the threshold 3*$\sigma_{noise}$ gives 99% probability of correct detection.

The maximum frequency $F_{max}$ for downhole communication must provide sufficient amplitude of the signal at the bottom hole. $F_{max}$ must not exceed$_{mod.max}$ provided by the generator. $F_{max}$ depends on the initial amplitude of the signal on the surface, attenuation (determined by the pipe and mud properties), maximum measured depth, and minimal detectable amplitude of the signal at the bottom which is limited by the sensitivity of the downhole pressure transducer. As discussed herein, high frequencies attenuate more than low frequencies, which necessitates use different values of $F_{max}$ for different ranges of measured depth of the well.

Figures 17, 18:
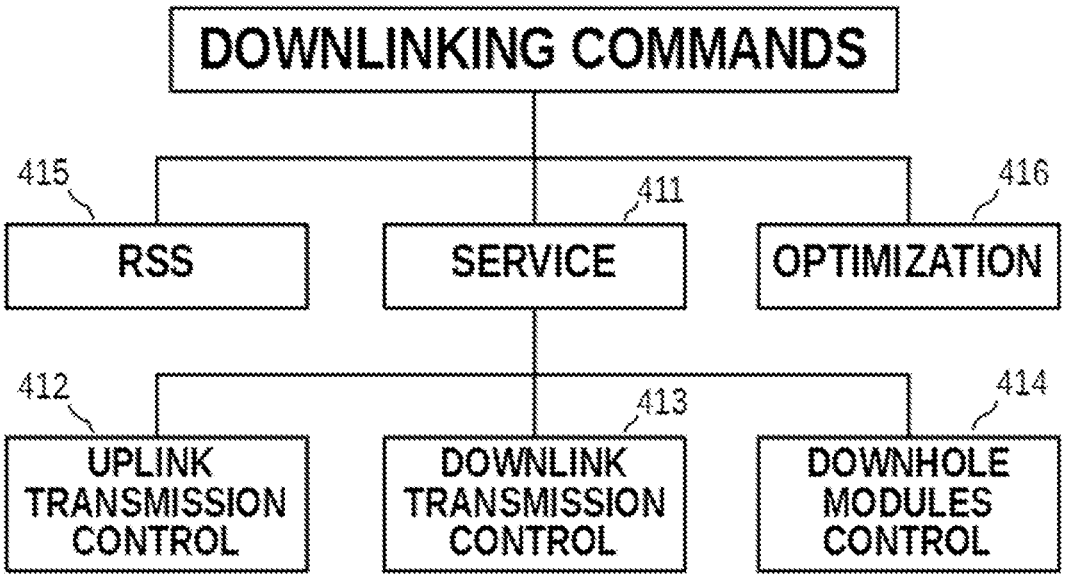
FIG. 17 is a table showing a number of combinations of orthogonal frequencies from a duration of signal T for words containing one, two and one and two letters, if a useful range of frequencies is equal 30 Hz.
FIG. 18 is a block diagram of various types of downlinking commands, which may be transmitted to a downhole transducer to manage acquisition optimization, trajectory control, and other control functions.

FIG. 17 shows the number of orthogonal frequencies depending on the duration T (column 391) of the signal for a frequencies range equal to 30 Hz for words with one letter (column 393), and two letters (column 394). The distance between adjacent orthogonal frequencies (column 392) of Δf=0.125 Hz provides 241 available combinations for one letter words and 58,081 combinations for two letter words for a frequencies range of 30 Hz. Such number of combinations is greater than the amount of the downlinking instructions (including their value used in the industry). In the presence of strong random noise, duration T may increase up to 5-7 minutes in order to suppress noise based on known effects that by the increase in duration T by N times allows for increasing the signal-to-noise ratio in IN times. The need to use Δf smaller than 0.125 Hz may be needed just in cases of extremely deep and long wells, when the frequencies range could be limited to 2-3 Hz. In such cases, the value of $\Delta f_{min}$ depends on the modulator 51 producing a single frequency with a particular accuracy. The minimum value $\Delta f_{min}$ can be determined by a predrilling test of modulator 51 accuracy by using data from the transducer 52.

The value of Δf minimum depends on the modulator 51 producing a single frequency with a particular accuracy. The value $\Delta f_{min}$ can be determined by a predrilling test of the generator accuracy by using data from the pressure transducer 52. The transmission of 6 bits is achieved by using a frequency range equal to 16 Hz, for example from 5.125 Hz to 21 Hz ($16*2^3$)=128 combinations or 6 bits. The example provided herein is a demonstration of the downlinking speed of the present invention, which is in the order of a few seconds per the downlinking instruction (as compared with a general range of about 2-7 min in traditional systems). The amount of preselected downlinking commands in the industry is generally less than 50-60. For such amount, the combination of transmission is possible using T=4 sec and $\Delta F$=15 Hz, resulting in a data transmission rate of almost 1.5 bit/sec (as compared to the industry practice of 1-2 bit/min).

A list of required downlinking commands depends on the tools included in BHA, the presence of a rotary steerable system, and the objectives of control and optimization of the drilling process, data acquisition, and transmission. Typically, as shown in FIG. 18, there are three groups of different commands. The group of service commands (service 411) and the group of RSS control commands (RSS 415) are generally known in the industry.

The group of optimization and energy saving commands (optimization 416) is a novel group which may be utilized by using the fast and robust continuous downlinking method and system disclosed herein. The optimization 416 group allows for maintaining a balance between the density of measurements, the rate of penetration, and the BHA tool's energy consumption.

Measurements while drilling process implies making a certain number of measurements (points) per meter according to the specified requirements. For example, requirements may demand not less than 5 points per meter (1 point per 20 cm) of a certain parameter measured and transmitted in real-time from the bottom hole to the surface. The telemetry system must provide the required density of measurements regardless of changing drilling conditions, for example, high or low rate of penetration.

Figure 19:
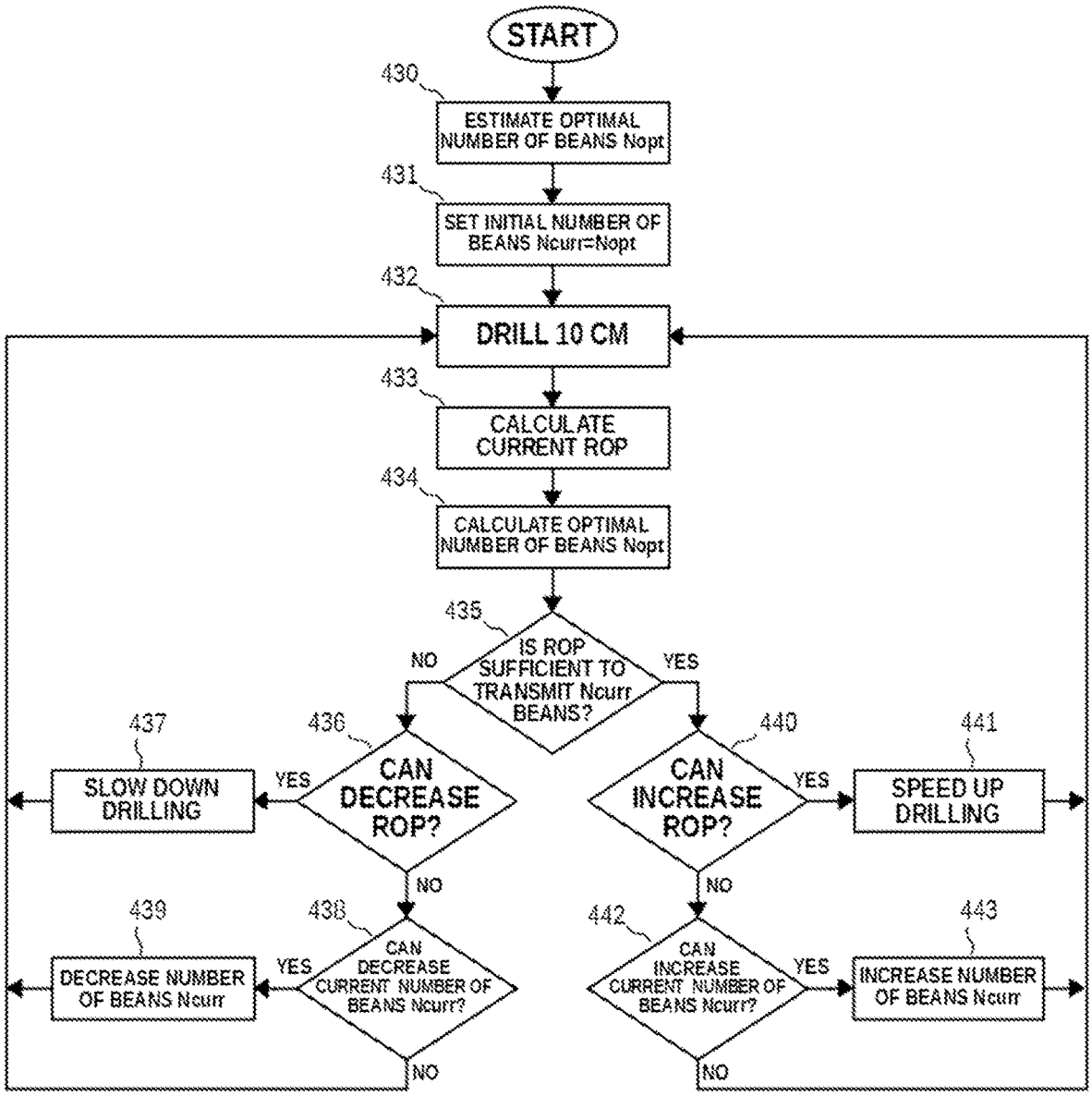
FIG. 19 is a flow chart illustrating optimization of data acquisition during LWD operation utilizing downlinking communication according to some embodiments of present invention.

FIG. 19 is a flow chart illustrating steps performed by the algorithm incorporated into the system for providing the balance between the amount of information for uplink transmission and the rate of penetration (ROP). The actual number of information is limited by the small bit rate of the uplink channel such that not all desired information can be transmitted to the surface without delay of the drilling process. If the rate of penetration is high, the drill string may pass the interval rapidly, and the required point density is not kept. Therefore, the system must determine and balance between the ROP and the transmitted information. The initialization stage (step 430) includes estimation of the optimal number of information to transmit based on the current configuration and prior knowledge. The system is configured to use the optimal number of information for transmitting to the surface (step 431). The actual value of ROP is calculated (step 433) for a small drilling interval (step 432). The optimal number of information (for transmitting to the surface) is calculated for the current ROP value (step 434). The current and calculated number of information is compared, and a decision is made how to balance the current ROP with the required number of measurements per meter (step 435). If the current rate of penetration is too high or the current bit rate is too low (step 436), there are two options available: slow down drilling (steps 436, 437) or decrease the number of information to transmit (steps 438, 439) via the uplink channel. After choosing a decision in accordance with the current situation and priorities, the loop is repeated again (step 432). If the current rate of penetration is small or the current bit rate allows to transmit more information to the surface (step 440), similarly, the choice is between two options: increase the ROP (steps 440, 441) or transmit more information to the surface (steps 442, 443) in accordance with the current situation and priorities.

While the device waits for the downlink command, the modulator can constantly or continuously generate a frequency for synchronization $F_a$ (assertion frequency). This serves several purposes. The moment of disappearance of $F_a$ should be treated as a start of data transmission. In reverse, the moment of detection of $F_a$ means the end of the message from the surface. The amplitude of $F_a$ at the bottom hole is used to monitor the quality of decoding and the calculation of the noise-to-signal ratio according to the following criteria:amplitude of $F_a$ must be bigger than three standard deviations of white noise components in the operating frequency range (A signal>3*$\sigma_{noise}$). If this condition is not fulfilled, the system has various measures to improve the signal-to-noise ratio in order to meet the above criteria. It is proposed to use $F_{max}$ as $F_a$ because $F_{max}$ has the highest amplitude attenuation.

Figure 20:
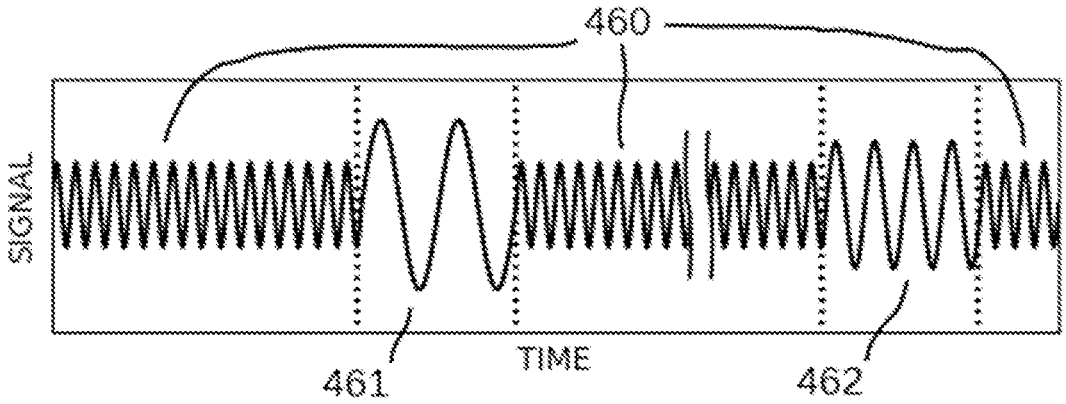
FIG. 20 is an example of two successive downlinking commands where the command function and value is represented by one letter of the combinatorial frequencies alphabet (white noise is not shown).

FIG. 20 shows two different downlinking commands (lines 461, 462) where a command function and value are encoded by one letter of a combinatorial frequencies alphabet. A space between the commands is filled with assertion frequency $F_a$=Fmax$_i$ (lines 460). Downlinking commands have a structure $\{F_a, F_c, F_a\}$ for downlinking commands having one alphabet member of the combinatorial alphabet, where $F_a$ represents the assertion frequency (line 460), $F_c$ represents the frequency of the commands (lines 461, 462) that correspond to one unique combination of purpose and value of the command. This structure is used if a number of unique frequencies provided by a selected range $F_{min}$–$F_{max}$ and $\Delta f$ exceeds a total number of combinations "command purpose+command value" calculated above.

Figure 21:
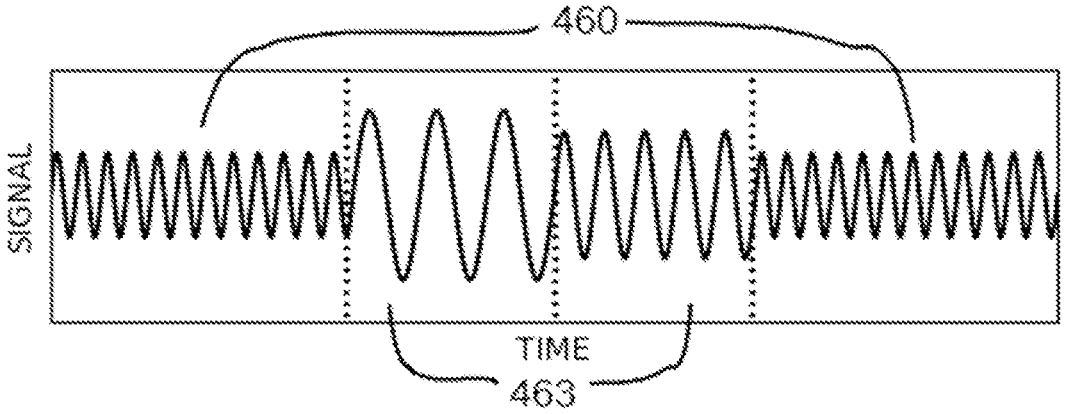
FIG. 21 is an example of one downlinking command, where the command function and value is represented by a word from two letters of the combinatorial frequencies alphabet (white noise is not shown).

FIG. 21 illustrates a situation in which in a frequency range of 2-5 Hz, the downlinking commands have two alphabet members of the combinatorial alphabet with a structure $\{F_a, F_c, F_{c2}, F_a\}$, where $F_a$ represents (5–2)/0.125+1=25 combinations. The total number of combinations using two letters is 25*25=626 combinations. Even in such narrow frequencies range, using the two letter combinatorial alphabet of the exemplary system, an amount of available combinations greatly exceeds an amount of practicable downlinking commands, including their purposes and values.

Figure 22:
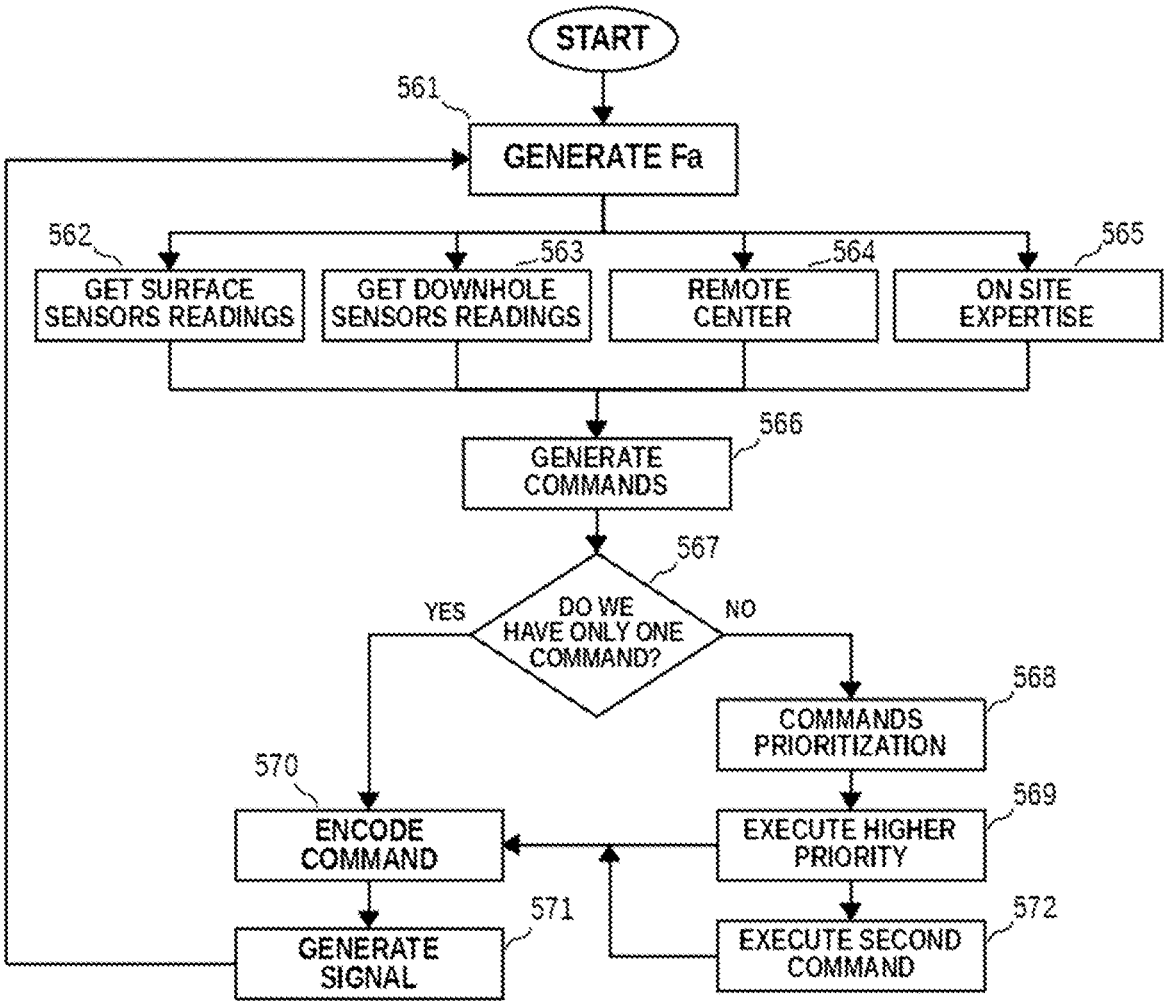
FIG. 22 is a flow chart illustrating sources and logic for developing downlinking instruction according to some embodiments of the present invention.

FIG. 22 is a flow chart illustrating the process steps of planning the downlinking commands. The modulator continuously generates the assertion frequency $F_a$ (step 561). The surface system receives readings transmitted from surface sensors (step 562), downhole sensors (step 563), receives instructions from the remote control center (step 564), and MWD/LWD operators (step 565). Based on the analysis of these sources, the system produces downhole command (step 566). If at a particular moment, there is only one downhole command to execute (step 567), then it is encoded (step 570) and the corresponding signal is generated (step 571). If there are competing commands (step 567), then command prioritization is performed (step 568). The highest rank has a general communication group of the downlinking commands, followed by the rotary steerable system control. The least priority may be assigned to the optimization group. The highest priority command is executed (step 569) by encoding (step 570) and signal generation (step 571). After execution of the command with the highest priority, the remaining commands (step 572) are executed a few seconds later.

Figure 23:
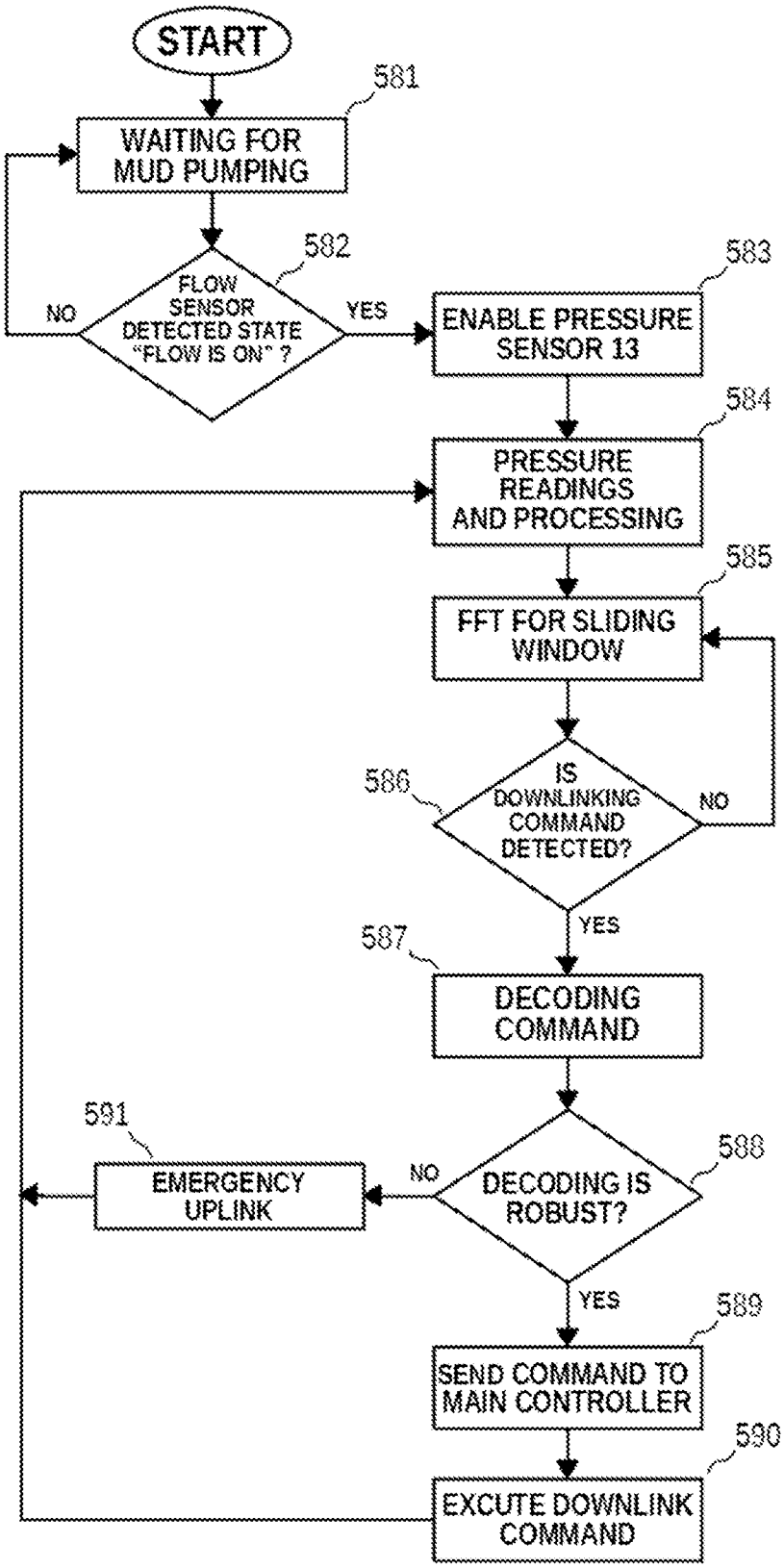
FIG. 23 is a flow chart illustrating components, processing, detection and decoding at the BHA according to some embodiments of the present disclosure.

FIG. 23 is a flow chart illustrating the process steps in the downhole related to recording, processing, detecting, decoding and execution of downlinking commands. The key component of the BHA 22 responsible for such actions are the transducer 13 and its controller, the main controller 16, the pulser modulator 21, and the flow sensor 11. The presence of drilling fluid flow is a mandatory condition for uplink and downlink signal transmission. Therefore, the BHA flow sensor initially waits for mud pumping and detects a state of the fluid flow (steps 581,582), transmitting the flow-state signals to other downhole modules thereby triggering or stopping operation of receiving new pressure values (step 583).

A transducer 13 continuously records and processes pressure measurements (step 584) in the presence of flowing drilling mud with a sampling frequency not less than $fs=2*F_{max}$ in accordance with the Nyquist—Shannon sampling theorem, where $F_{max}$ is a maximum frequency in a range used for downhole data transmission. The sensitivity of the pressure sensor determines a minimum detectable amplitude of the harmonic, and it must be taken into account for estimation of the amplitude of decaying downlink signals. In the example used above to illustrate novelty of the present invention, the sensitivity of the pressure sensor was assumed as 0.01 psi and a minimum detectable downhole amplitude level as 0.1 psi.

A controller of the pressure sensor transmits new pressure readings into a memory buffer for further processing. This allows for accumulation of a sequence of pressure values during time span $t>T_{max}$ (where $T_{max}$ is a maximum signal duration) that is sufficient for analysis. A pressure signal in the buffer is constantly or continuously monitored for a presence or absence of assertion frequency $F_a$. A modulator at the surface operates in two states: 1) generating a downlinking command; and 2) generating $F_a$ if the command is absent. A pressure sensor controller determines the exact moments where $F_a$ disappears (i.e., the signal begins) and $F_a$ shows up again (i.e., the signal ends) when performing processing. A corresponding fragment of the signal between $T_{begin}$ and $T_{end}$ is treated as an encoded downlinking command that must be decoded. The processing starts with applying FFT to the selected fragment of signal. Removing the zero-frequency component and performing band-pass filtering allows remaining only in the working range of frequency components between $F_{min}$ and $F_{max}$. The presence of a certain frequency is determined by estimation of the corresponding FFT component.

A particular firmware module of a pressure sensor controller (referred to herein as "decoder") performs FFT for the window sliding along the time axis with step $\Delta t=1$ second. The following example illustrates the concept of signal detection. The assertion frequency can be $F_a=40.125$ Hz, signal frequency can be fs=40 Hz, duration of the signal can be T=8 seconds, and a presumption is made that the amplitudes of $F_a$ and fs meet the criteria A signal$>3*\sigma_{noise}$. It should be understood that the provided example is an extreme case, since the amplitudes are practically identical. For the majority of frequencies ranging from $F_{min}$ to $F_{max}$, the amplitudes of signals are stronger than amplitudes of $F_a$, resulting in more contrast, simplifying the correct determination of the signal frequencies.

Figure 24A:
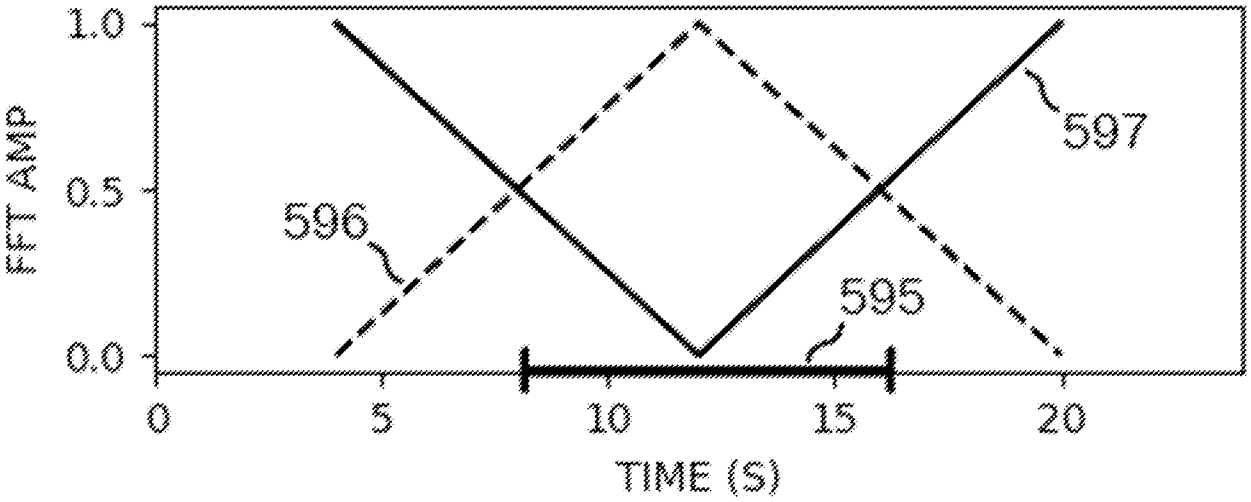
FIGS. 24A and 24B show a pattern of signal and white noise behavior of amplitude spectrum after applying Fast Fourier Transform on a sliding base.
Figure 24B:
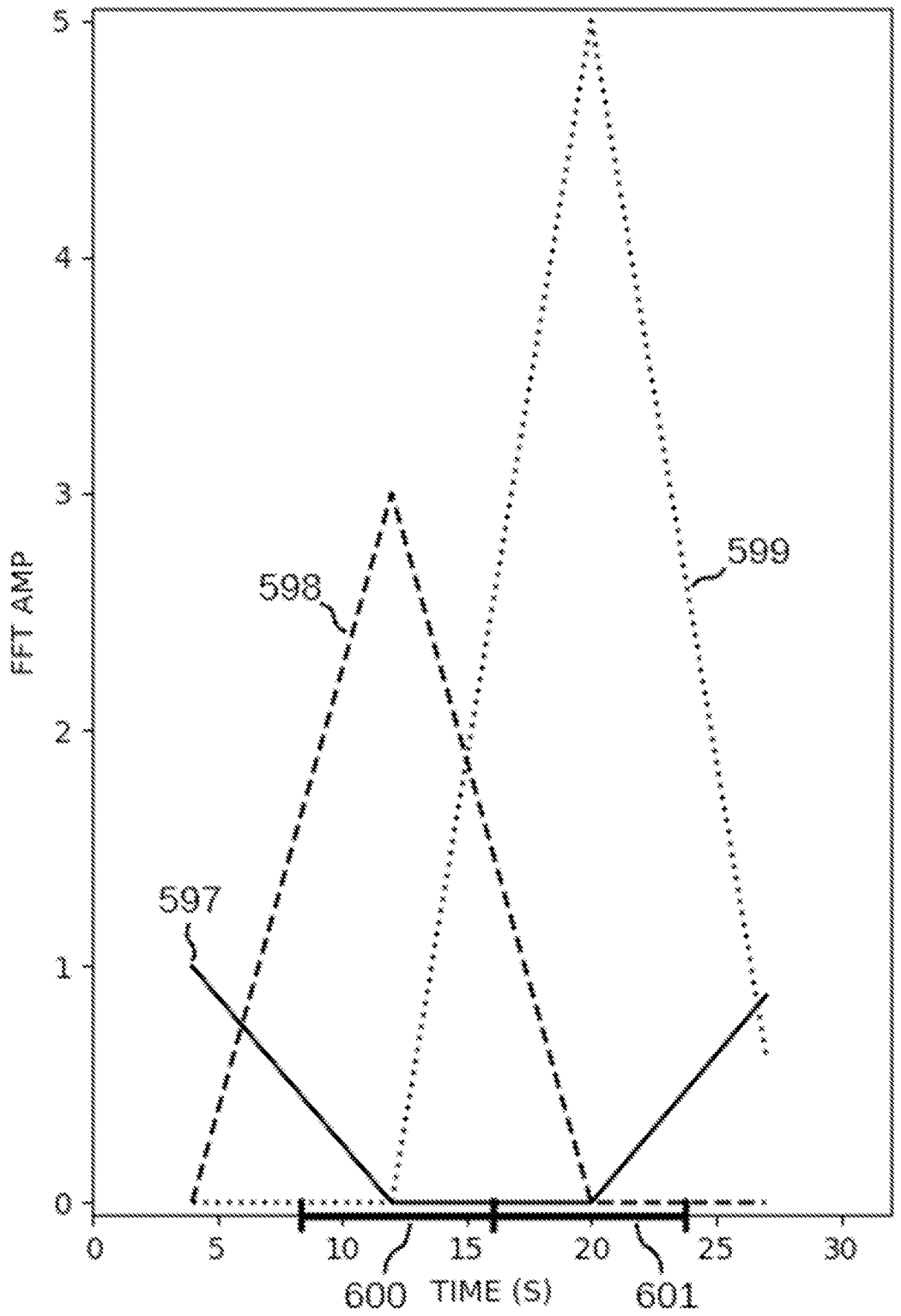

FIG. 24A shows the interval of the presence of the downlinking command (595) of signal fs=40 Hz on the time axis and the corresponding FFT amplitudes for the assertion frequency $F_a=40.125$ Hz. The peak of the curve 596 and trough of the curve 597 correspond to the center of the signal presence. Only the frequency corresponding to the signal forms a triangle-like shape. FIG. 24B shows results of FFT on a sliding base for downlinking commands which is formed by two letters followed one by another. The first letter is a frequency 20 Hz with relative spectrum amplitude equal to 3 (line 598), the second letter is a signal with a frequency 15 Hz with relative amplitude equal to 5 (line 599). The peak of each curve (598 and 599) corresponds to the middle of the signal presence (middle of interval 600 for curve 598, and the middle of interval 601 for curve 599). The amplitude spectrum for $F_a$ (line 597) shows absent of $F_a$ around the junction of the two letters. FIG. 25B demonstrates that automatic pattern recognition is simple and robust, and the system allows for reliable decoding during processing at the BHA level.

With reference again to FIG. 23, the decoder determines the decoded command (step 586), estimates the decoding quality (step 587), and if the criteria of a robust decoding is not satisfied, then the BHA starts the emergency uplink procedure (step 591) to inform the surface about the signal-to-noise ratio being below the predefined threshold level. Uplink data may also include additional downlinking control options, such as a signal-to-noise ratio for different frequencies, an amplitude of $F_{sync}$ ($F_{max}$) component, band noises, or the like. If the downlinking command was interpreted incorrectly, measurements shown in FIG. 25 could be used by the system to automatically increase the downlinking signal and repeat transmission of the last command. Command data generally consists of two parts: 1) a command type (defining a purpose of the command); and 2) a value of the corresponding parameter.

Figure 25:
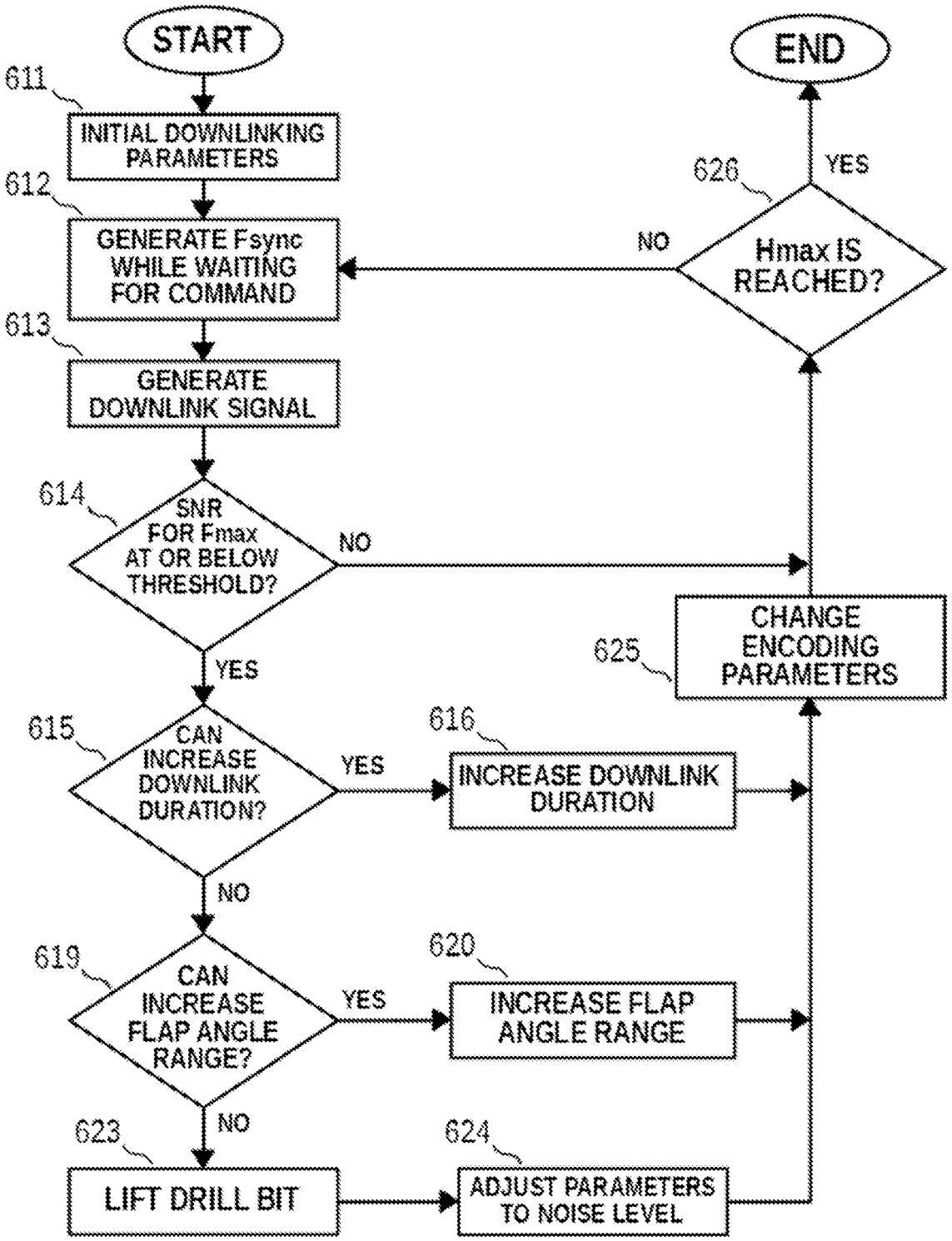
FIG. 25 is a flow diagram illustrating options to increase signal to white noise ratio according to some embodiments of the present disclosure.

The exemplary system and method discussed herein include various options designed to increase the signal-to-noise ratio. FIG. 25 is a flow chart illustrating the logic and the sequence of steps required to satisfy the condition of a reliable signal detection in the presence of random noises. Estimation and application of the initial parameters for downlinking is initially performed (step 611). The modulator 51 at the surface continuously generates an assertion frequency and waits for detection of the downlinking command (step 612). The system generates the corresponding downlinking signal as soon as the command is ready (step 613). The BHA receives the downlinking signal (step 614), tries to decode the command and estimates the decoding quality. If the signal cannot be detected reliably, the emergency uplink procedure is performed to notify the surface system about insufficient signal strength. Alternatively, in a normal operating situation, the BHA may include information about the $F_{max}$ amplitude in the uplink data stream. Basing on this information, the surface system estimates the need to increase the signal amplitude at the surface. If the system determines that the magnitude of the signal (step 614) is sufficient, none of following options are required, and the system operates without changes, performing checks if the maximum depth $H_{max}$ is reached (at each iteration) and the drilling should be stopped. If the system decides that decoding is reliable, the BHA command is executed and the entire loop is repeated again. If the situation requires an increase of the signal-to-noise ratio, the first option is making the downlinking signal longer (steps 615, 616). If the increase of T is not possible or the maximum acceptable duration is already applied, the second option is increasing the angle range $\varphi_{min}-\varphi_{max}$ of the flap (steps 619, 620). The last option (step 623) unlikely happens within the proposed approach. However, such option would require stopping of the drilling process and lifting the drill bit (in most traditional applications this is a mandatory way to complete downlinking operation successfully). Downlinking parameters can be adjusted to the noise level (step 624). All changes in the downlinking encoding/decoding scheme are made (step 625), for example, by applying a new duration T of downlinking signal.

Figure 26:
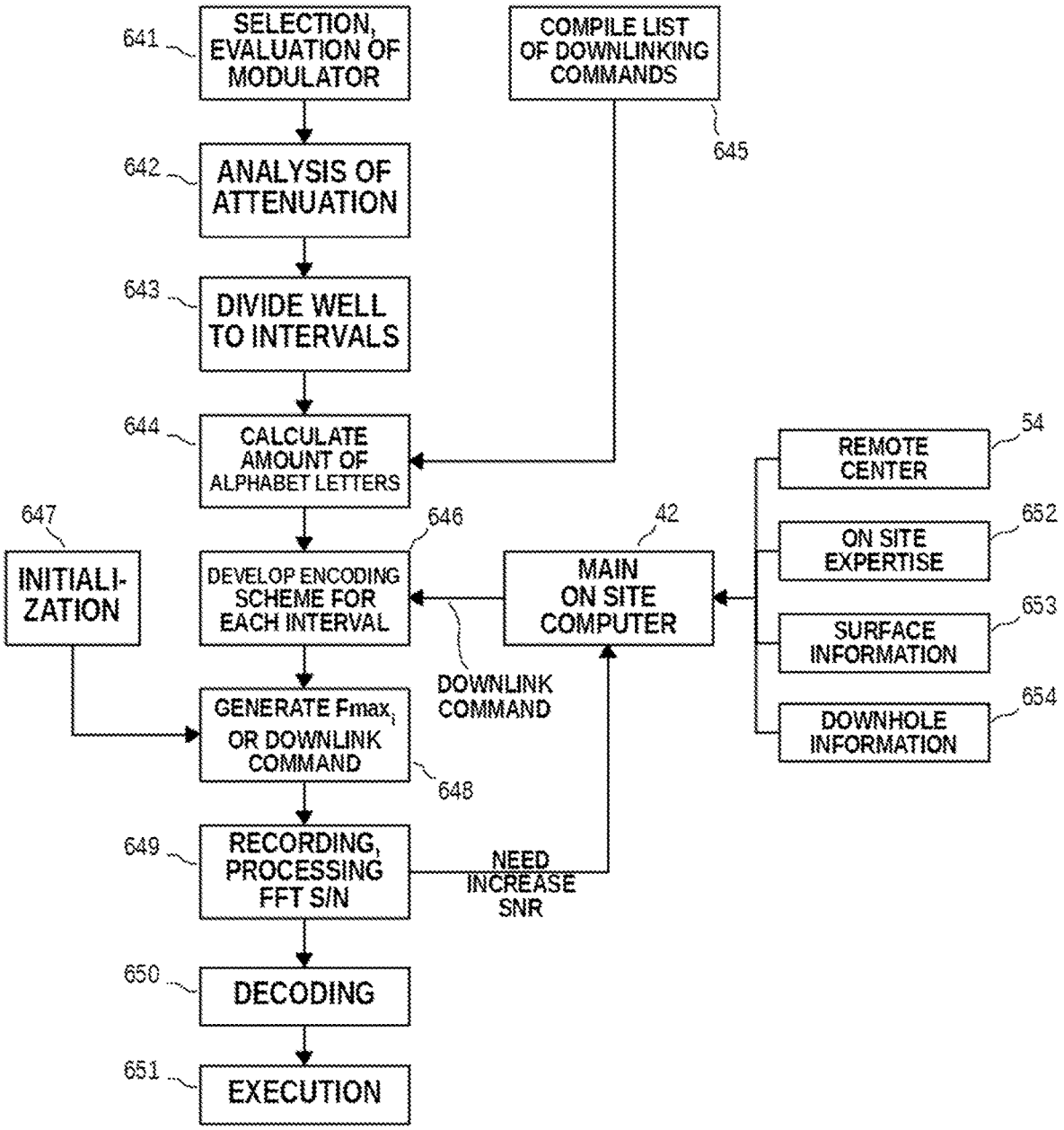
FIG. 26 is a flow chart illustrating the combinatorial frequencies alphabet method according to some embodiments of the present disclosure.

FIG. 26 provides a detailed flow chart overview of the flow chart shown in FIG. 2 in order to visualize one illustration of various steps of components of the combinatorial frequencies alphabet method and their relationships. Some components (such as the main onsite computer and software 42, the modulator 51, and the remote center 54 were shown in previous figures). All remaining components have a new numeration to more clearly illustrate their communication, flow and mutual dependency. For simplicity and clarity, not all steps and components of the method are shown in FIG. 26.

The exemplary method and apparatus of the present invention overcomes the disadvantages of the traditional systems by providing a broad range of orthogonal frequencies by a modulator 51 disposed onside of the fluid supply line, with exception of a rotational flap disposed inside of the supply line pipe. The fast oscillating flap generates a relatively low amplitude of harmonic pressure waves in the range of 1-7 bar (15-105 psi) and causes little interference with surface pumping equipment. A modulator 51 transmits commands and data to a downhole transducer 13 disposed in the BHA, as previously described with reference to FIG. 1.

The pressure transducer may have a sensitivity 0.01 psi or, in some situation with deep wells, can have a sensitivity of even 0.001 psi. Analysis of pressure wave attenuation (step 642) in FIG. 26 provides quantitative evaluation of the frequency attenuation in the range from less than 1 Hz up to $F_{max}$ of a modulator in the measure depth of drilling up to $H_{max}$ of the well. In order to have a robust recording by the transducer 13, an amplitude of a pressure waves with a particular frequency may have an amplitude 10-15 times higher than a sensitivity of the pressure transducer. For a deep well, the present invention provides for the option of division of a well trajectory for a few intervals (step 643) where for each interval the range of frequencies is selected. It is possible that for the deep portion of the well, the range of orthogonal frequencies can have an amplitude 10-15 times higher than the transducer 13 sensitivity consisting of only low frequencies, resulting in a reduced amount of components in the combinatorial frequencies alphabet. In such situations, have a full list of downlinking commands (step 645) (including functionality and values) and the amount of frequencies components for a letter of the combinatorial frequencies alphabet (step 644), an encoding scheme is developed by the system for each interval (step 646). For most wells and for a significant part of the trajectory of long wells, all predefined downlinking commands may be encoded by using only single letter words. In other cases, the encoding scheme can include a combination of words with double letters.

The exemplary system and method of continuous downlinking is designed to include information about well geometry, casing program, drilling technology, BHA components and sensors, surface sensors, requirements for acquisition density, and other related information. The planning stage of the exemplary system and method includes steps 641, 642, 643, 644, 645, 646, as well as a setup of communication and initialization (step 647). The exemplary system and method allows for broadening of the range of downlinking commands and uses more bits to represent the command values. The method includes at least three group of commands: service/supporting commands; commands for managing RSS parameters; and commands to optimize data acquisition densities/parameters, including instruction on saving energy sources. The final step of preparation to the downlinking during LWD operation includes the initialization stage (step 647).

After the drilling operation starts, the pump is on, the downlink modulator starts generation of harmonic pressure wave signals on the frequency equal to $F_{max}$ selected for the first measure depth interval. At the BHA level, the pressure transducer is initiated by the "flow stat" sensor, starts recording, processing and performs FFT on the sliding base resulting in calculation of the signal-to-white noise ratio. If the ratio fall down below the threshold, the uplink command is initiated requesting a need to increase said ratio. The system includes a few options for such purpose. One option is increasing duration of a signal. Processing of continuous frequency $Fmax_t$ allows to calculate at the downhole level duration T of the downhole signals, which ensures robust detection and decoding in the presence of white noise with energy 100 and more time stronger than a downlinking signal.

Thus, prior to generating a downlinking command, the system has information on downlinking command duration T, sufficient for robust detection and decoding of a downlinking command. A process of generating an immediate downlinking command includes receiving data from downhole sensors, surface located devices (steps 654, 653), and requests from onsite (step 652) and remotely located experts (block 54). Software from the main onsite computing device is configured to produce an immediate downlinking command based on processing of the above data and information. Such command is encoded and transmitted to a modulator 51 for execution.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A method for continuous downlinking communication from a surface location to a bottom hole assembly during drilling operation, the method comprising:

(a) pumping drilling fluid through a surface-located fluid line and through a drill string to the bottom hole assembly;

(b) generating continuous pressure wave signals with a modulator associated with the surface-located fluid line, each signal of the pressure wave signals including at least one letter of a downlinking combinatorial frequencies alphabet;

(c) detecting and receiving at the bottom hole assembly the continuous pressure wave signals generated by the modulator;

(d) processing and decoding the continuous pressure wave signals with a decoder associated with the bottom hole assembly to identify digital signal periodical components, and determine a command type and value, for controlling drilling operations;

wherein at least one of:

(i) the modulator is coupled to the surface-located fluid line, the modulator includes a flap rotatably disposed within the modulator such that the flap is entirely disposed within the surface-located fluid line, and the method comprises selectively rotating the flap within the surface-located fluid line to vary an amplitude of the continuous pressure wave signals generated by the modulator, wherein the amplitude of the continuous pressure wave signals generated by the modulator is a function of and correlates to an angular position of the flap relative to a direction of fluid flow within the surface-located fluid line;

(ii) the at least one letter of the downlinking combinatorial frequencies alphabet includes one or more orthogonal frequencies, the alphabetic component with a highest frequency $F_{max}$ is determined based on evaluation of the modulator, a selection of the modulator is based on a required value of the highest frequency $F_{max}$, and an amount of orthogonal frequencies K in the downlinking combinatorial frequencies alphabet is determined based on a range of frequencies from a minimum frequency $F_{min}$ to a maximum frequency $F_{max}$, and on a selected equivalent duration T of output of a single alphabet member of the downlinking combinatorial frequencies alphabet by $K=((F_{max}-F_{min})/\Delta f)+1$, where $\Delta f=1/T$ represents a difference in Hz of adjacent orthogonal frequencies, and $T=1{,}024*2^n$ ms, where n=0, 1, 2 . . . ;

(iii) a choice of the command type and value of a downlinking command is based on a combined evaluation of real-time data from bottom hole assembly sensors, surface gages, drilling parameters, information from an onsite operator, and instruction from a remote center, and the method comprises encoding the downlinking command and transmitting corresponding one or more alphabet letters to a controller of the modulator to generate a harmonic pressure wave signal;

(iv) the command type associated with the continuous pressure wave signals is divided into three groups: service commands, RSS commands for managing rotary steering system parameters, and optimization commands for optimization of at least one of acquisition and saving energy resources, wherein if multiple command types are transmitted simultaneously, the method comprises prioritizing the service commands as highest priority, the RSS commands as a second highest priority, and the optimization commands as lowest priority; or (v) the method comprises detecting a presence of flow of the drilling fluid by a sensor disposed in the bottom hole assembly, wherein the sensor is a flow stat device, and comprising initiating recording of the continuous pressure wave signals by a pressure transducer after detection of the presence of flow of the drilling fluid by the sensor, and a. wherein a sampling frequency of the sensor is not less than $2*F_{maxi}$, where $F_{maxi}$ is a maximum frequency for an i interval; or b. the method comprises removing a constant zero frequency component, applying band-pass filtering and preforming band selectable Fourier analysis on a sliding base equal to a used duration of the at least one letter of the downlinking combinatorial frequencies alphabet to process the pressure wave signals recorded by the pressure transducer, wherein: a processor of the pressure transducer recognizes harmonics, which includes decoding of a downhole signal to determine a command purpose and associated command value; and decoding is based on pattern recognition of a behavior of harmonic components of the continuous pressure wave signals along a timeline after applying Fourier analysis on the sliding base.

2. The method of claim 1, comprising selecting three or more oscillating ranges for the flap, wherein a first oscillating range generates a pressure wave amplitude of 15-25 psi inclusive, a second oscillating range generates a pressure wave amplitude of 40-50 psi inclusive, and a third oscillating range generates a pressure wave amplitude of 80-90 psi inclusive.

3. The method of claim 1, wherein:

the maximum frequency $F_{max}$ is assigned as an assertion frequency $F_a$, and an amount of orthogonal frequencies in the combinatorial frequencies alphabet K* is calculated by $K^*=K-1$;

an output signal is a combination of one or two alphabet letters, where a second letter of the two alphabet letters is adjacent to a first letter, wherein:

if an amount of frequencies components for one letter is greater than an amount of all predefined downlinking commands including general purpose and communication group instructions for managing RSS and optimization prescription, then a downlinking command includes from one letter with a structure as $\{F_a, F_{si}, F_a\}$, wherein $F_{si}$ is one of the frequencies components form the range from $F_{min}$ to $F_{max}-\Delta f$, each signal frequency component represents a unique combination of one downlinking command purpose and its value; and if the amount of predefined downlinking commands is greater than an amount of the frequencies components of one letter of the combinatorial alphabet, a downlinking signal includes from two letters with a structure as $\{F_a, F_{si}, F_{si}, F_a\}$, wherein $F_{si}$, $F_{si}$, are frequencies components, the combination of downlinking command purpose and its value, and the combination $F_{si}$, $F_{si}$ represents one of the downlinking commands.

4. The method of claim 1, comprising adjusting the range of frequencies for attenuation during propagation of the continuous pressure wave signals from the modulator to the bottom hole assembly.

5. The method of claim 4, wherein an effect of the attenuation is represented by:

$$P = P_0 \exp\left[-4\pi f\left(\frac{D}{d}\right)^2\left(\frac{\mu}{K}\right)\right]$$

where P is a signal strength at a surface transducer; $P_0$ is a signal strength at the modulator; f is a carrier frequency of a measurement-while-logging signal; D is a measured depth between a downhole transducer and the modulator; d is an inside diameter of a drill pipe; μ is a plastic viscosity of the drilling fluid; an K is a bulk modulus of a volume of drilling fluid above the downhole transducer.

6. The method of claim 5, wherein based on an effect of the attenuation on higher frequencies alphabet members, a length of a drilling well is divided by two of more intervals and each interval has a different value of maximum frequency $Fmax_i$, where i is a number of intervals.

7. The method of claim 5, wherein the modulator continually generates the maximum frequency $F_{max}$ before and after transmitting the continuous pressure wave signals to the bottom hole assembly.

8. The method of claim 7, comprising continuously using the maximum frequency $Fmax_i$ to analyze a signal-to-white noise level ratio wherein:

a criteria for a robust detection of alphabetic harmonic components of the downlinking signals is established when an amplitude of spectrum of a signal harmonics is higher than three standard deviations of amplitude of white noise (A signal>3*$\sigma_{noise}$);

an increase of the signal-to-white noise level ratio is achieved by downlinking duration of the at least one letter each time when uplink communication indicates that an amplitude of spectrum for the maximum frequency $Fmax_i$ is not sufficient;

if an amplitude spectrum for the maximum frequency $Fmax_i$ is not sufficient, an increase of the signal-to-noise ratio is achieved by increasing the duration of the downlinking command;

if the duration of the downlinking signal reaches a predefined limit, a more aggressive range of the flap rotation is used; and when all options are exhausted, and an energy of white noise is 200 times or more than an energy of signal harmonics, the method comprises lifting a drill bit from the bottom hole assembly.

9. The method of claim 5, wherein:

a division for the intervals is based on predetermined criteria for a minimum amplitude value for each frequency in order to allow robust recording of the generated continuous pressure wave signals for a pressure transducer; and robust recording necessitates that the amplitude of each frequency at the bottom hole assembly depth is 10-15 time greater than a sensitivity of the pressure transducer.

10. A system for continuous downlinking communication from a surface location to a bottom hole assembly during drilling operation, the system comprising:

(a) a surface-located fluid line;

(b) a pump configured to pump drilling fluid through the surface-located fluid line and through a drill string to the bottom hole assembly;

(b) a modulator coupled to the surface-located supply line and including a flow obstruction component disposed partially in the surface located fluid line, the modulator is configured to generate encoded pressure fluctuations in the drilling fluid flowing through the surface-located fluid line by changing a flow area within the surface-located fluid line with the flow obstruction component;

(c) a mud pulse telemetry system associated with the bottom hole assembly including at least one sensor for measuring formation properties;

(d) a downhole pressure sensor configured to detect the encoded pressure fluctuations generated by the modulator in the drilling fluid;

(e) a downhole controller and processor configured to process and decode downlinking commands associated with the encoded pressure fluctuations; and (f) a main controller in communication with the bottom hole assembly configured to execute the decoded downlinking commands to control drilling operations wherein at least one of:

(i) the bottom hole assembly includes at least one sensor capable of identified a presence of drilling fluid flow due to pumping of the drilling fluid by a pump through the surface-located fluid line, detection of starting of pumping and stopping of pumping of the drilling fluid through the surface-located fluid line triggers a start and end, respectively, of recording of pressure fluctuations by a pressure sensor, the pressure sensor includes a processor, software, circuit boards, and a pressure measuring device, a sensitivity of the pressure measuring device is 0.01 psi or 0.001 psi, the pressure sensor is configured to record, filter, process pressure wave fluctuation, and perform amplitude spectrum analysis using a Fast Fourier Transform, a controller, processor and software are configured to decode the downlinking command by using pattern recognition of signal frequencies based on Fast Fourier Transform results from calculation on a sliding base;

(ii) the modulator continuously generates the encoded pressure fluctuations with a harmonic signal with a frequency equal to a maximum frequency $Fmax_i$ before and after downlinking commands, and a pressure transducer sensor in the bottom hole assembly is configured to calculate a signal-to-white noise level ratio; or (iii) the flow obstruction component is a flap rotatably disposed within the modulator such that the flap is entirely disposed within the surface-located fluid line, and a. the modulator is configured to selectively rotate the flap clockwise or counterclockwise in a predefined range of angles of rotation to vary the open area for drilling fluid flow in the surface-located fluid line, and wherein varying a position of the flap generates pressure wave harmonic signals according to selected encoding scheme of a downlinking combinatorial frequencies alphabet; or b. the flap includes female-type mount on opposite edges for coupling to a rotating shaft on one side and connection to a non-rotating shaft on an opposite side, the flap coupled to both the rotating and non-rotating shafts by pins.

11. The system of claim 10, wherein the flow obstruction component is a flap rotatably disposed within the modulator such that the flap is entirely disposed within the surface-located fluid line.

12. The system of claim 11 wherein the flap at angular position $\varphi=0°$ provides a minimum restriction to the flow of the drilling fluid through the surface-located fluid line and corresponds to a fully open position in which an open area for drilling fluid flow in the surface-located fluid line is a maximum value, and the flap positioned at a rotation angle of ±90° from the angular position $\varphi=0°$ corresponds to a fully closed position in which an open area for drilling fluid flow in the surface-located fluid line is a minimum value.

13. The system of claim 10, wherein:

the rotating shaft is mechanically connected to a shaft of an electrical motor via a coupling;

the rotating and non-rotating shafts are sealed by double mechanical seals with hydraulically balanced friction face-to-face pairs; and sealing of the rotating and non-rotating shafts is complemented by supply of barrier fluid with a 1-3 bars higher pressure than pressure in the surface-located fluid line.

14. The system of claim 13, wherein:

the modulator is coupled to the surface-located fluid line with attachment flanges and crossover subs located on each side of the modulator;

the electrical motor is disposed outside of the surface-located fluid line, the electrical motor having a power unit in the form of a battery or power source; and driving of the modulator with the electrical motor is regulated by a motor controller.

15. The system of claim 14, wherein:

a main onsite computer transmits through a data exchange device a sequence of letters of the downlinking combinatorial frequencies alphabet which represents an encoded downlinking command;

the modulator generates a pressure wave fluctuation in accordance with the sequence of letters of the downlinking combinatorial frequencies alphabet; and the electric motor adjusts an angular position of the flap based on feedback control signals to maintain the encoded downlinking command.

16. The system of claim 15, wherein control of the electrical motor is performed using hall sensors.

17. The system of claim 10, wherein:

an initial signal duration of a single combinatorial alphabet letter T is doubled each time when an uplink request is generated until a new calculated time is less than a predefined $Tmax_1$, where $Tmax_1$ is a maximum duration of time allowed for transmission of one letter; or the signal-to-white noise level ratio is increased using a more aggressive angle of flap rotation.

18. The system of claim 17, wherein when all options are exhausted and an energy of white noise is 200 times or more than an energy of signal harmonics, the drill bit is lifted from the bottom hole assembly and the single combinatorial alphabet letter T is adjusted by varying the angular position of the flap.

19. The system of claim 18, wherein a decoded downlinking command type and value is transmitted via internal wires to the main controller of the bottom hole assembly for an execution.

20. The system of claim 19, wherein a surface sensor real-time information, downhole real-time data, remote center guidance, and onsite operations are processed on the main onsite computer to produce appropriate downlinking instructions to apply the encoded combinatorial alphabet signal schemes at the bottom hole assembly.

21. The system of claim 10, wherein the flap defines a substantially round disc-like shape with a diameter smaller than an inner diameter of the surface-located fluid line.

22. The system of claim 10, wherein the pressure transducer sensor is configured to request through an uplink communication an increase of the signal-to-white noise level ratio if the calculated signal-to-white noise level ratio drops below a predefined threshold level.

* * * * *